US010890026B2

(12) United States Patent
Vianello

(10) Patent No.: US 10,890,026 B2
(45) Date of Patent: Jan. 12, 2021

(54) AUTOMATIC MACHINE FOR ALTERNABLE APPLICATION OF A PLURALITY OF FLEXIBLE SPACER PROFILES ON A GLASS SHEET

(75) Inventor: Fortunato Vianello, Vallio Roncade (IT)

(73) Assignee: FOR.EL S.P.A., Roncade (IT)

( * ) Notice: Subject to any disclaimer, the term of this patent is extended or adjusted under 35 U.S.C. 154(b) by 138 days.

(21) Appl. No.: 13/551,709

(22) Filed: Jul. 18, 2012

(65) Prior Publication Data

US 2013/0020006 A1 Jan. 24, 2013

(30) Foreign Application Priority Data

Jul. 19, 2011 (IT) ..... TV2011A0102

(51) Int. Cl.
*E06B 3/673* (2006.01)

(52) U.S. Cl.
CPC ..... *E06B 3/6733* (2013.01); *Y10T 156/10* (2015.01); *Y10T 156/1744* (2015.01)

(58) Field of Classification Search
CPC ..... Y10T 156/10; Y10T 156/1744; E06B 3/6733; E06B 3/66309; E06B 3/66304
See application file for complete search history.

(56) References Cited

U.S. PATENT DOCUMENTS

| | | | | |
|---|---|---|---|---|
| 4,769,105 | A | 9/1988 | Lisec | |
| 6,148,890 | A | 11/2000 | Lafond | |
| 2003/0178127 | A1 | 9/2003 | Lisec | |
| 2006/0080915 | A1 * | 4/2006 | Vianello et al. | 52/204.593 |

FOREIGN PATENT DOCUMENTS

| | | | |
|---|---|---|---|
| EP | 1347142 | A2 | 9/2003 |
| EP | 1650396 | A2 | 4/2006 |
| IT | TV2009A000027 | | 3/2009 |
| IT | TV2009000207 | | 10/2009 |
| WO | 2011047398 | A2 | 4/2011 |

OTHER PUBLICATIONS

European Search Report EP12 17 6740; dated Sep. 12, 2012; Citing WO2011/047398.

* cited by examiner

*Primary Examiner* — Christopher T Schatz
(74) *Attorney, Agent, or Firm* — Panitch Schwarze Belisario & Nadel LLP

(57) ABSTRACT

An automatic machine and an automatic method for the alternating application of a plurality of flexible spacer profiles, preferably made of expanded synthetic material, on a glass sheet in order to compose the insulating glazing, where a dynamic magazine, which contains a plurality of reels of flexible spacer profile is paired with an application head and the path of the flexible spacer profile lies around the rotation axis of the application head, thus rendering feeding from the magazine compatible, thereby allowing the alternability of the reels, with the functionality of the application head, which requires a 360° freedom of rotation.

1 Claim, 19 Drawing Sheets

AUTOMATIC MACHINE FOR ALTERNABLE APPLICATION OF A PLURALITY OF FLEXIBLE SPACER PROFILES ON A GLASS SHEET

BACKGROUND OF THE INVENTION

Currently it is known to deposit a rigid spacer frame or a flexible spacer profile on a glass sheet and to then mate the assembly with a second glass sheet in order to form an insulating glazing. The operation can be also repeated in order to obtain insulating glazing comprising three glass sheets and two rigid spacer frames or flexible spacer profiles, as well as n glass sheets and n−1 rigid spacer frames or flexible spacer profiles.

In order to better understand the configuration of the glass sheet, in its use in combination with a rigid spacer frame or a flexible spacer profile to form an insulating glazing, some concepts which relate to the semi-finished products including the glass sheet 2 and the rigid spacer frame 3 or the flexible spacer profile 3 and the final product, i.e., the insulating glazing 1, assuming that the subsequent use of the insulating glazing, i.e., as a component of the door or window, is known are summarized hereafter.

The insulating glazing 1 is formed as a composition of two or more glass sheets 2 separated by one or more rigid spacer frames 3, which are generally hollow and microperforated on the inwardly directed face. The hollow part of the spacer frames contains hygroscopic material. The chamber (or chambers) delimited by the glass sheets and by the rigid spacer frame (or frames) is (are) able to contain air or gas, or mixtures of gases that give the double glazing unit particular properties, for example, thermal insulation and/or soundproofing properties. Recently, the use of a spacer profile 3 which has an essentially rectangular cross-section, and is made of flexible and elastic expanded synthetic material (by way of non-limiting example, silicone and/or EPDM) which incorporates in its mass the hygroscopic material has become widespread. The foregoing type of profile which is the focus of the following disclosure has four advantages: (1) the low coefficient of heat transmission by conduction; (2) the bond with the glass, which becomes instantaneous because it is entrusted to the acrylic adhesive and not to the traditional thermoplastic sealant, which is subject to flow until the second sealant, described hereinafter, catalyzes; (3) the state of supply in reels that contain lengths of a few hundred meters and therefore with greater feed endurance, differently from the profile for the rigid frame supplied in bars with a maximum length of six meters; and (4) its applicability in automation.

The connection between the glass sheets and the rigid spacer frame or frames is obtained by two levels of sealing: the first level providing tightness and the initial bond between these components and affecting the lateral surfaces of the frame and the portions of the adjacent glass sheets; and the second level providing the final cohesion among the components and the mechanical strength of the joint between them and affecting the compartment constituted by the external surface of the frame and by the faces of the glass sheets up to the edge thereof (see FIG. 1). In the case of a flexible spacer profile 3 made of expanded synthetic material, and more precisely in the so-called "dual seal" version, the first level of sealing is replaced by an adhesive 5, for example an acrylic adhesive, already spread on the lateral faces of the spacer profile 3 and covered by a removable protective film 5' which is removed during the step of application on the glass sheets. In the "triple seal" version, in addition to the acrylic adhesive the profile comprises a portion intended also for hermetic sealing, but the present invention does not relate to this version.

The glass sheets 2 used in the composition of the insulating glazing 1 can have different shapes depending on its use. For example, the outer glass sheet (outer with respect to the building) can be standard or coated with so-called selective nanodeposits or with solar control (in order to limit the thermal intake during summer months), or laminated/armored (for intrusion/vandalism prevention functions), or laminated/toughened (for security functions), or combined (for example nanocoated and laminated in order to obtain a combination of properties). The inner glass sheet (inner with respect to the building) can be standard or coated with so-called low-emissivity nanodeposits (in order to limit the dispersion of heat during winter months), or laminated/toughened (for security functions), or combined (for example nanocoated and laminated in order to obtain a combination of properties).

It will be evident that a production line for obtaining the insulating glazing product 1 needs many processes in sequence and comprises the application of the rigid spacer frame or flexible spacer profile 3, considered as the main element in the present patent application.

The processes for the production of the insulating glazing 1, each requiring a corresponding and particular machine to be arranged in series with respect to the other complementary ones, by way of non-limiting example and at the same time not all necessary, include the following:

EDGING on the peripheral face of the glass sheet in order to remove any nanocoatings so as to allow and maintain over time the bond of the sealants and, in the case of the subject of the present disclosure, of the acrylic adhesive and of the sealant;

CHAMFERING of the sharp edges of the glass sheet, both to eliminate edge defects introduced with the cutting operation (dangerous trigger sites for any fractures, particularly for the case of toughened glass, which therefore is always arrissed), and to reduce the risks of injury in the subsequent handling of the glass sheets and of the insulating glazing 1;

WASHING of the individual glass sheets, with alternation of inner glass and outer glass sheet or of inner glass sheet/intermediate glass sheets/outer glass sheet, or vice versa;

APPLICATION OF THE SPACER FRAME: a spacer frame, filled with hygroscopic material and coated on the lateral faces with a thermoplastic sealant that has sealing functions, in machines which are external with respect to the production line of the insulating glazing 1, is applied on one of the two glass sheets that constitute the standard insulating glazing 1 in a dedicated station of the production line of the insulating glazing 1. As an alternative, and this relates to the present invention, a continuous strip of flexible spacer profile 3 is unwound from a reel and applied to one of the two glass sheets until it forms a closed frame, adhering to the glass sheet, after removal of the protective film 5' that covers the adhesive 5 (generally of the acrylic type), and on the same production line of the insulating glazing 1;

MATING AND PRESSING of the glass sheet(s)/frame(s) assembly;

FILLING WITH GAS of the chamber or chambers thus obtained, an operation which can be performed also during the mating step: and SECOND SEALING: sealing of the perimetric edge of the insulating glazing 1 in order to provide a mechanical/ chemical and therefore structural bond between the spacer frame 3 and the glass sheets 2.

The processes listed above can be performed by the respective machine in a semiautomatic or an automatic manner.

In particular, in the background art, depositing the flexible spacer profile 3 made of expanded synthetic material occurs according to two modes: (1) semiautomatic (i.e., with the intervention of the operator), typically on a tilting table which modifies its own arrangement from a vertical arrangement, when it receives the glass sheet from the line, to horizontal arrangement, when the operator deposits the profile, with the aid of a guiding and scoring tool; or (2) automatic (i.e., without the intervention of the operator), typically and preferably in a section that has a vertical arrangement like the production line of the insulating glazing 1, without however excluding solutions with a horizontal arrangement.

Prior art documents describing conventional machines and methods for applying the spacer profile on glass sheets include the following: EP 1 347 142 B1, both for method and device, with German priority DE 2002 102 12 359 A1 dated 20 Mar. 2002 and US equivalent US2003/0178127, patent owner Lisec Peter that is specific for the spacer profile made of expanded synthetic material; U.S. Pat. No. 6,148,890 dated 10 Jun. 1998 regarding a device, patent owner Lafond that is specific for the spacer profile made of expanded synthetic material; U.S. Pat. No. 4,769,105 with Austrian priority dated 1 Sep. 1986, related to a device, patent owner Lisec, regarding the application of a spacer profile on a glass sheet, but made of filled thermoplastic material; EP 1 650 396 B1, related to a device, with Italian priority TV2004A000117 dated 20 Oct. 2004, patent owner FOR.EL. BASE di Davanzo Nadia & C. s.n.c., TV2009A000207 dated 22 Oct. 2009, related to a device and a method, patent owner For.El S. p. A.

The foregoing documents respectively teach the following:

EP 1 347 142: how to control the tensile and shearing stresses in the flexible spacer profile proximate to the region of application on the glass;

U.S. Pat. No. 6,148,890: the method of conduction of the flexible spacer profile to the glass sheet;

U.S. Pat. No. 4,769,105: how to control the tensile stresses in the flexible spacer profile before feeding to the application head;

EP 1 650 396 B1: the innovative way of conveying the spacer profile to the glass sheet, which allows the further invention that is the subject of the present application; and TV2009A000207: how to make possible the alternate use of a plurality of flexible spacer profiles, a solution which is quite surpassed, in terms of innovation, by the invention to which the present application relates.

Technical problems that are inherent in the foregoing citations include the following (all of which are addressed by the present invention disclosure):

- complexity of the operation for replacing the reel (both in the case of depletion and in the more frequent case of replacement of the type of the spacer profile 3);
- lack of production flexibility due to the complexity of the operation for replacing the reel;
- excessive length of the waste of spacer profile in the operation for replacing the reel;
- excessive expenditure of time in the operation for replacing the reel;
- impossibility to proceed with the replacement of the reel or of one of the reels of the magazine with guiding up to the application head while the head is operational, with the need to interrupt the process for applying the spacer profile and therefore the process of the entire production line of the insulating glazing 1 every time it is necessary to change the spacer profile 3;
- the need to resort to a double application head, certainly in the case of triple insulating glazing 1 which has two spacer profiles of different type, in any case in order to reduce, albeit without eliminating, the time for replacement of the spacer profile;
- limiting to only two types of spacer profile; and
- the need and difficulty of controlling tensile, compression and shearing stresses in the flexible spacer profile 3, especially when the reel is fixed to the ground, both when it is in stand-by and working modes. Therefore, the distance between the reel and the glass sheet 2 is not only considerable but also variable, due to the translation of the application head.

SUMMARY OF THE INVENTION

Briefly stated, one embodiment of the present invention is directed to an automatic machine for applying a flexible spacer profile (3) on at least a first glass sheet (2) mateable with at least a second glass sheet (2) so as to constitute an insulating glazing (1). The machine comprising a plurality of reels (401), each reel (401) containing a respective flexible spacer profile (3). A conveyor (100) is supportingly engageable with a lower edge (2*a*) of the first glass sheet (2) and able to move the first glass sheet (2) along a horizontal axis (x). A carriage (201) is movable in translational motion along a vertical axis (y), and an application head (300) is coupled to and movable with the carriage (201) and rotatable about a rotational axis (φ) perpendicular to the vertical axis (y) of the carriage (201). The application head (300) has a belt drive (304*a*, 304*b*) engageable with the flexible spacer profile (3) and free rollers (303*a*-303*d*) arranged to guide the flexible spacer profile (3) arriving from one reel of the plurality of reels (401) towards the application head (300). Each reel of the plurality of reels (401) is provided with a respective feeder assembly (400, 500, 600) for the flexible spacer profile (3); each feeder assembly comprising a reel unwinding unit (400), a take-up unit (500), and a transfer unit (600). The transfer unit (600) guides the flexible spacer profile (3) to and from the belt drive (304*a*, 304*b*) of the application head (300) by way of jaws (601, 602) which constitute grippers moved by a pneumatic or electric actuator (604). The feeder assembly of each reel (401) of the plurality of reels (401) is disposed on a magazine (700) comprising a footing (701) having movable sliders (702*a*, 702*b*) on which the feeder assembly is couplable, and uncouplable and guidable to the application head (300). The application head (300) is engageable with a selected one of the feeder assemblies of the respective reel, and the respective flexible spacer profile (3) is fed to the first glass sheet (2) along a path that winds around the rotational axis (φ) of the application head (300).

BRIEF DESCRIPTION OF THE DRAWINGS

Further characteristics and advantages of the present invention disclosure will become better apparent from the following detailed description of a preferred but not exclusive embodiment of an automatic machine, illustrated by way of non-limiting example by means of the accompanying drawings, wherein:

FIGS. 1G and 1H show a spacer profile made of synthetic material, with adhesive lateral faces.

DETAILED DESCRIPTION OF THE INVENTION

Figures 1A, 1B, 1C, 1D, 1E, 1F, 1G, 1H:
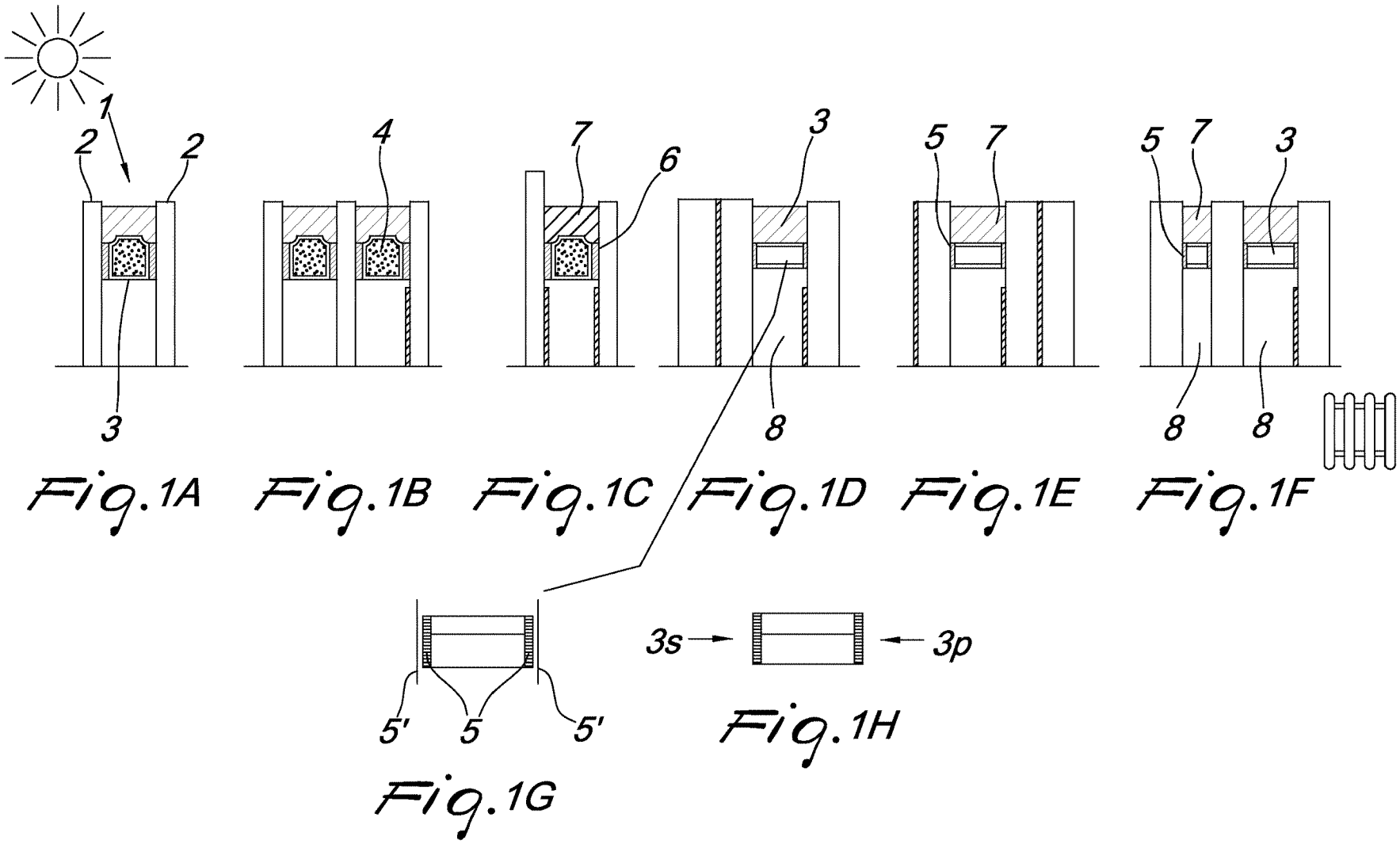
FIGS. 1A-1H are schematic views of the peripheral portion of the insulating glazing unit 1 in a non-exhaustive exemplifying series of possible combinations: 1A standard; 1B triple glazing unit with inner glass sheet of the low-emissivity type; 1C staggered glass sheets, both coated, respectively the inner one of the low-emissivity type and the outer one of the selective type; 1D laminated outer glass and low-emissivity inner glass; 1E hardened reflective outer glass sheet and laminated low-emissivity inner glass sheet; 1F triple glazing unit with inner glass sheet of the low-emissivity type and spacer frames that have a different width between one gap and the other.

Referring to the drawings in detail, where like numerals indicate like elements throughout, there is shown in FIGS. 1-19 a first preferred embodiment of the automatic machine generally designated 1000, and hereinafter referred to as the "machine" 1000 and method for applying a flexible spacer profile 3 on at least a first glass sheet 3 mateable with at least a second glass sheet so as to constitute an insulating glazing 1, in accordance with the present invention.

FIGS. 1A, 1B, and 1C illustrate an insulating glazing 1 with the conventional rigid spacer frame 3 made of microperforated hollow metal or microperforated hollow plastic or composite material containing a hygroscopic material 4 (or desiccant material). The two types of sealant used are highlighted: a first sealant 6 shown in black is a butyl sealant, which has the function of forming the initial bond between the components and of a first seal applied between the lateral surfaces 3*p* and 3*s* of the frame and the glass sheets 2 and a second sealant 7 shown in dashed lines is a polysulfide or polyurethane or silicone sealant, which has the function of mechanical strength applied between the outer surface of the spacer frame 3 and the faces of the glass sheets 2 up to the edge thereof.

FIGS. 1D, 1E, and IF show the spacer frame obtained by means of a flexible spacer profile 3 made of expanded synthetic material of the "DualSeal" type spread with adhesive 5 which forms an immediate bonding between the spacer profile and the glass sheets and is protected with a film 5' which is removed before application on the glass sheet 2, and also show the sealant 7 which constitutes the second seal, and which is generally obtained with hot melt or reactive hot melt but also with polysulfide or polyurethane or silicone.

In FIGS. 1D and 1F, the gas 8 (not visible) is contained in the chamber delimited by the spacer frame 3 and by the glass sheets 2 (and which can be present also in all of the other configurations of FIGS. 1A-1F).

The internal/external orientation is visually identified with icons that represent the sun (outer side) and the radiator (inner side). FIGS. 1A-1F illustrate the spacer frame in the composition of the insulating glazing 1, especially in the embodiments in which the thicknesses and weight of the glass sheets 2 are considerable (in the case of laminated glass sheets). Therefore the use of the spacer profile 3 made of expanded synthetic material, see FIGS. 1G-1H, whose lateral faces 3*p* and 3*s* are spread with acrylic adhesive 5, is particularly valid, because it allows the instantaneous bonding of the glass sheets 2 with the spacer 3, already after mating, differently from the butyl sealant alone as in the conventional technique with spacer profile made of metallic material or plastic, in which this bond is entrusted, while waiting for the catalysis of the binary sealant 7, exclusively to the butyl sealant 6, which is thermoplastic and does not bear loads but is subject to viscous flow (a critical aspect especially in the composition of the insulating glazing obtained with three glass sheets and two spacer frames for which the central glass sheet is not supported in know conveyors of the sealing machine).

Moreover, the flexible spacer frame made of expanded synthetic material has a conductivity coefficient that is far lower than that of the metallic rigid spacer frame, leading to higher-performing characteristics of thermal insulation of the insulating glazing. Finally, the flexible spacer profile is provided in the plurality of reels which contain a few hundred meters, thus substantially increasing the endurance of the product fed to the machine.

However, such a flexible spacer made of expanded synthetic material, supplied in the plurality of reels, needs to be replaced at each variation of the type of profile required by the production program or upon depletion of the reel contents. In particular, in the execution of triple insulating glazing the solution of the flexible spacer, indeed because it is supplied in reels, would be inconvenient with respect to the rigid frame solution, because it would not allow the execution of the two chambers with different gap dimensions.

Figure 2:
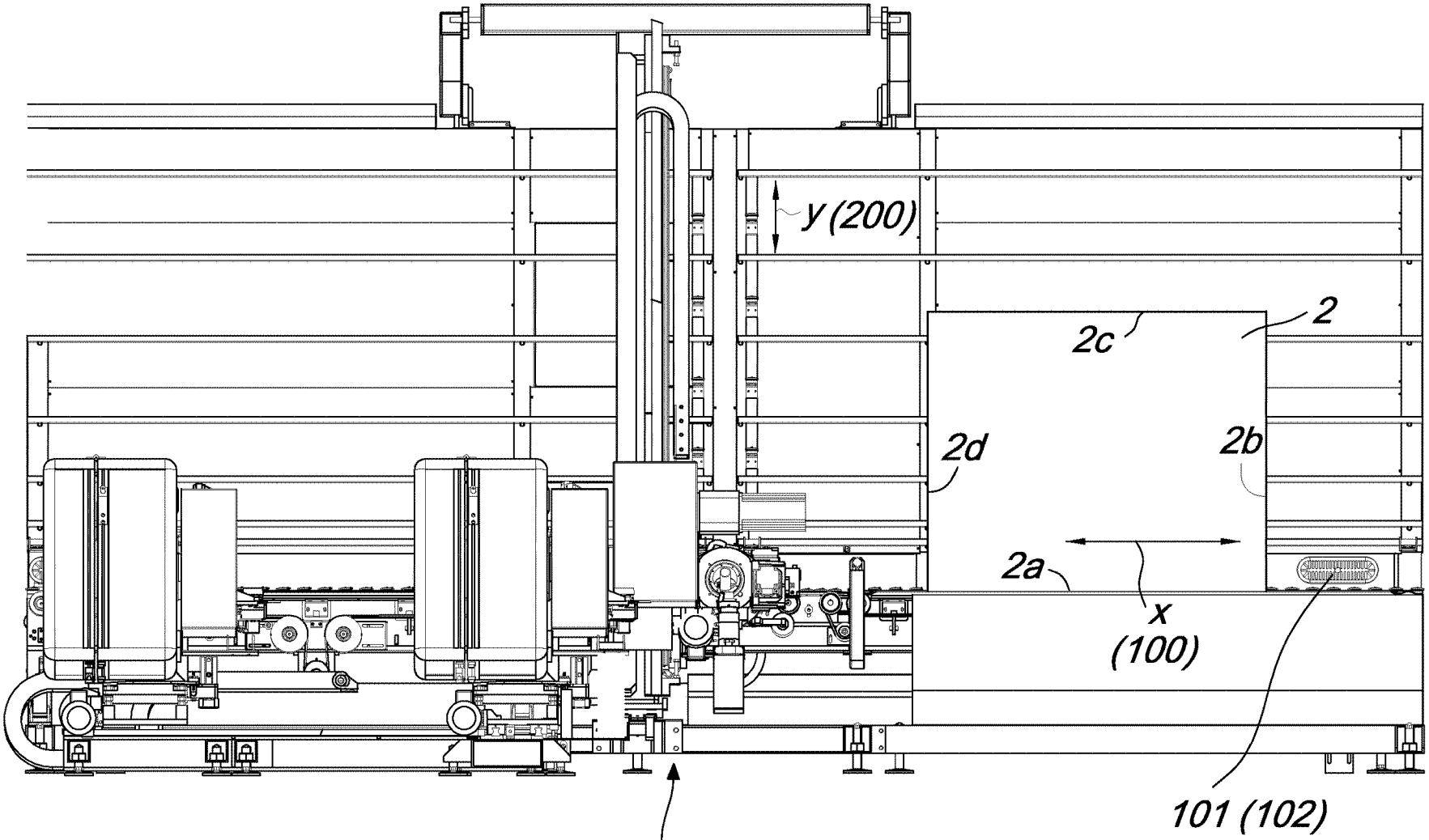
FIG. 2 is a front view of a preferred embodiment of the machine according to the present invention including assemblies for the horizontal runway x and for the vertical runway y.
Figure 3:
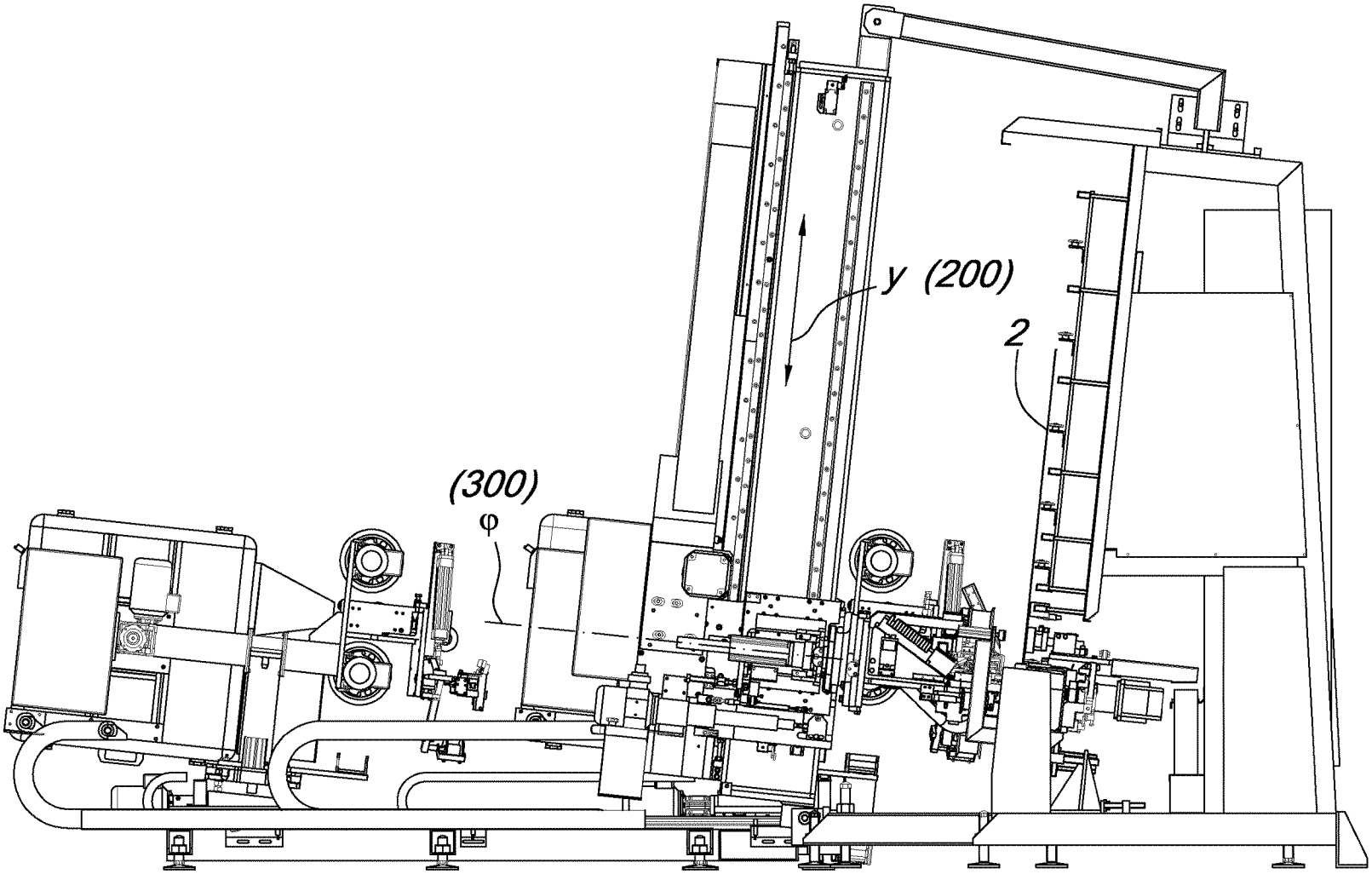
FIG. 3 is a side view of the machine of FIG. 2 including the assemblies for the vertical runway y with the vertical carriage 200, the application head 300 with rotation axis φ, and the reel movement assemblies.
Figure 4:
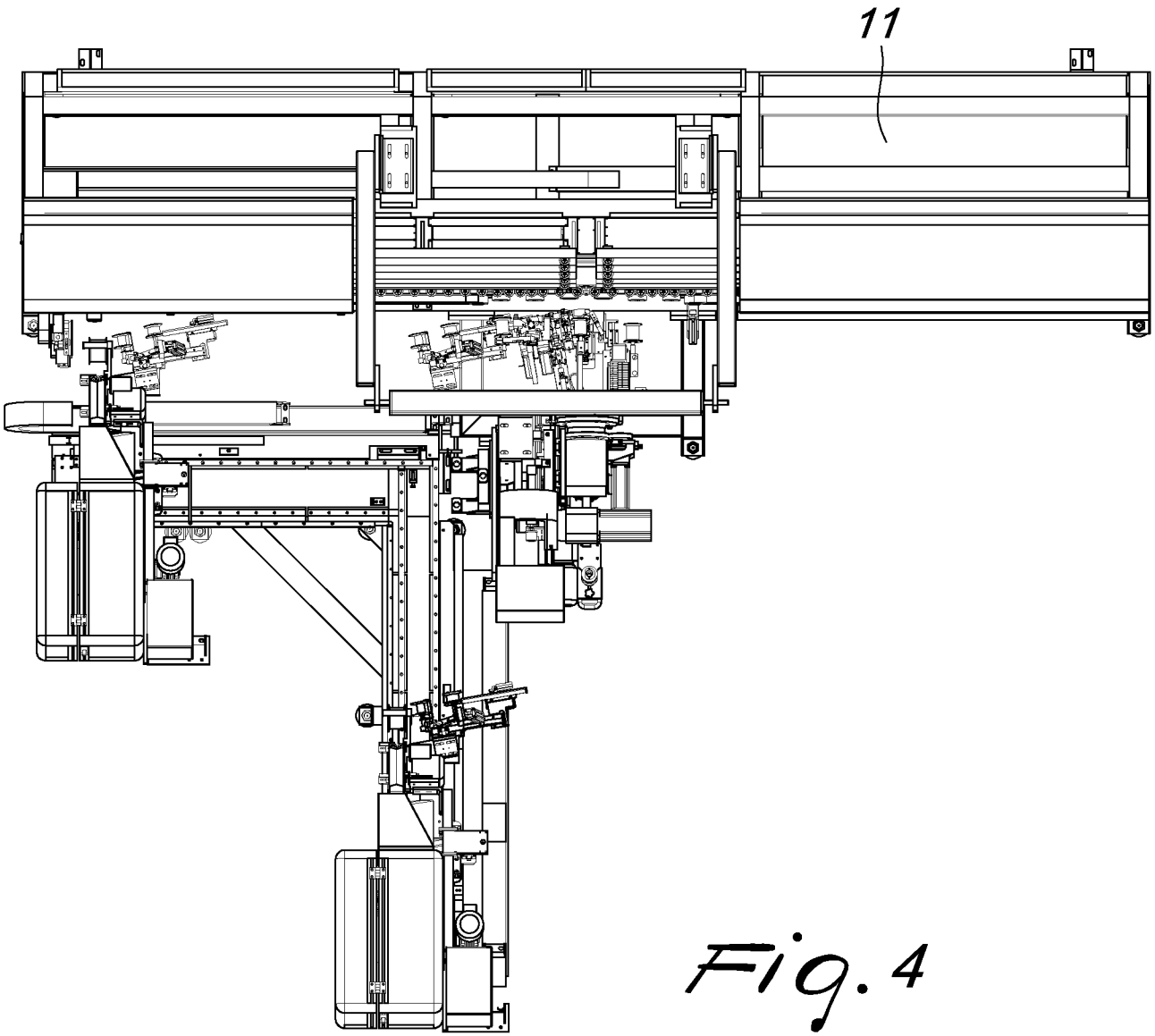
FIG. 4 is a plan view of the machine including the rear electrical panels.

FIGS. 2, 3 and 4 have the main purpose of defining the arrangement of the axes of the main actuation systems x, y, φ according to the background art. Regarding the movement axes of the reel units away from and toward the application head, FIGS. 2, 3 and 4 represent in their combination the principle of interfacing between reels from the reel magazine and the application head 300. FIGS. 2, 3 and 4 refer to a machine in which the workflow occurs from right to left.

The numbering logic of the figures is as follows: Series 200 represents the vertical runway with vertical carriage (y axis); series 300 represents the application head (φ axis), series 400 represents the reel actuation unwinding units, including the unit, series 700, represents the movement thereof, the movement being related also to the two subsequent units, series 500 represents the film takeup unit, series 600 represents the transfer unit (the interface mechanisms) between the series 400-500 and the series 300. Series 400, 500 and 600 constitute respective feed assemblies, each of which is either stored in the reel magazine or coupled to the carriage 201 for the application of the spacer profile 3 to the glass sheet 2.

Figure 5:
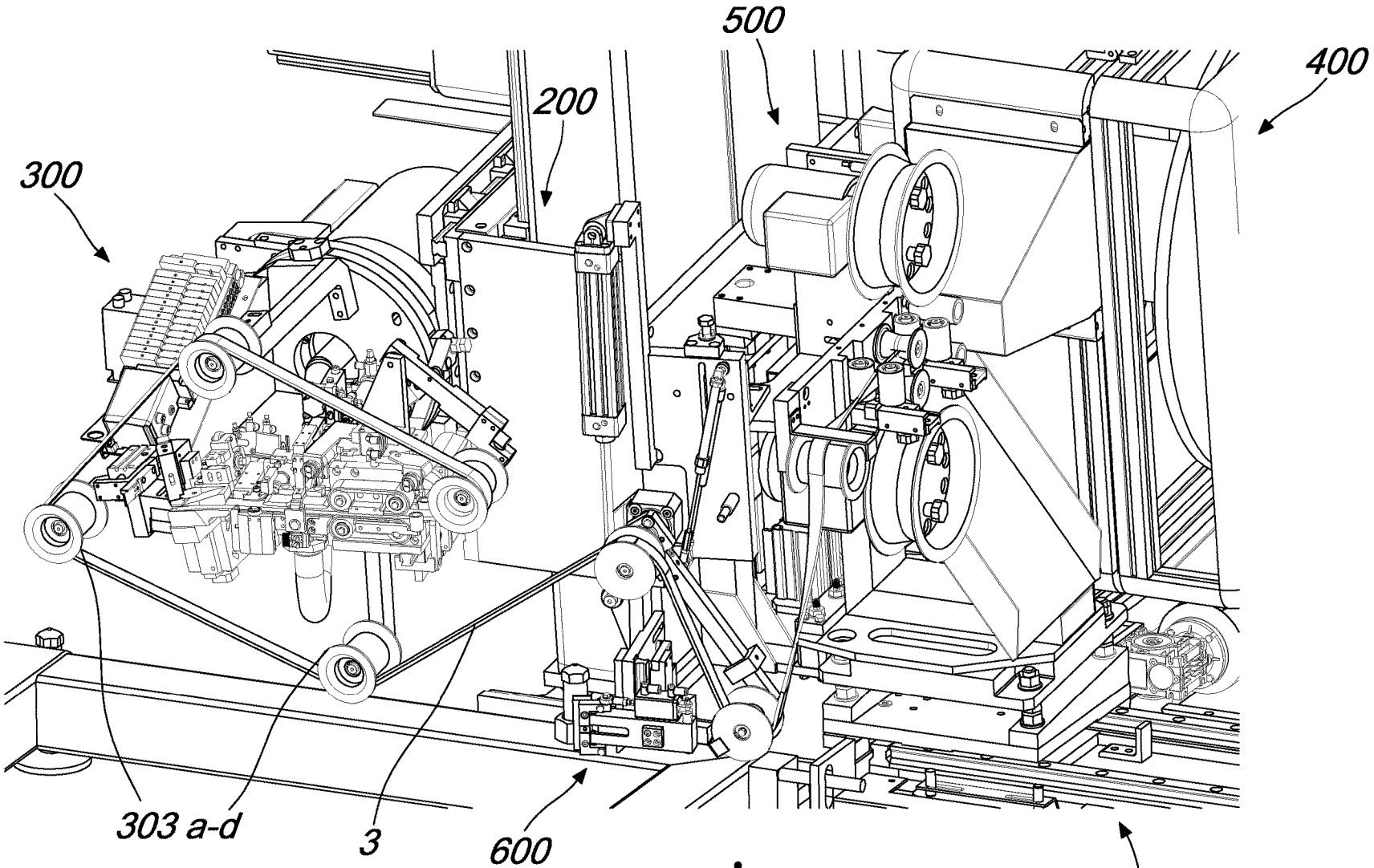
FIG. 5 is a view of the main components of the machine divided into units and the part of the known components interfaced with the inventive ones, also divided into units.

In summary, units 600 and 700 are inventive parts; units 200, 300, 400, 500, in addition to the unit 100, which is not shown in FIG. 5 but can be inferred from FIG. 2, are known parts. The path of the flexible spacer profile 3 coming from one of the plurality of reels is shown in FIGS. 2 and 5 in the condition for starting the process for application to the glass sheet 2.

Figure 7:
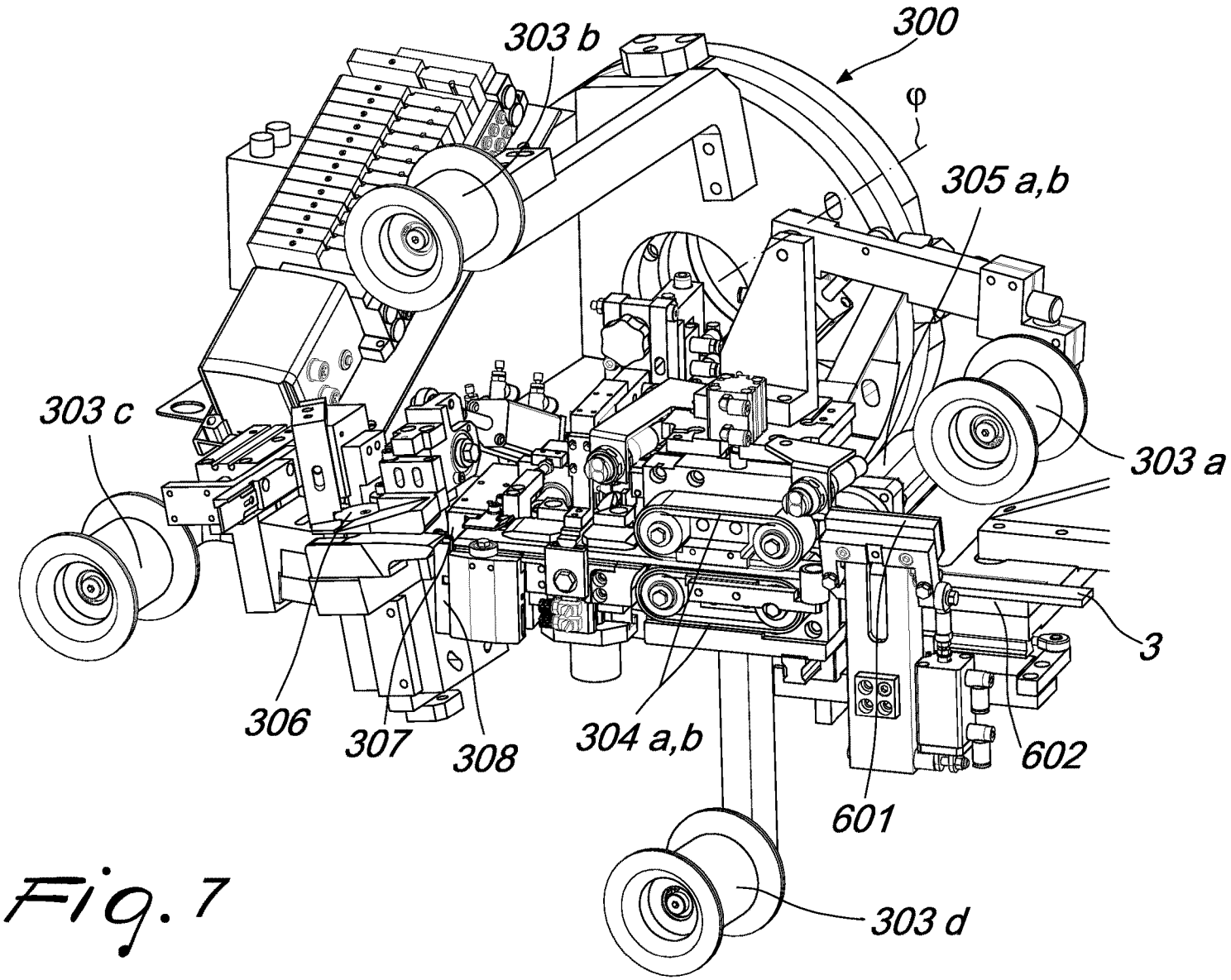
FIG. 7 is a view, taken from the side of a glass sheet, in working, of the unit series 300, according to the background art (EP 1 650 396 B1), modified to be compatible with automatic reel changing, particularly showing its interfacing in the condition of initial takeup of the spacer profile 3 toward the feeder assembly.
Figure 8:
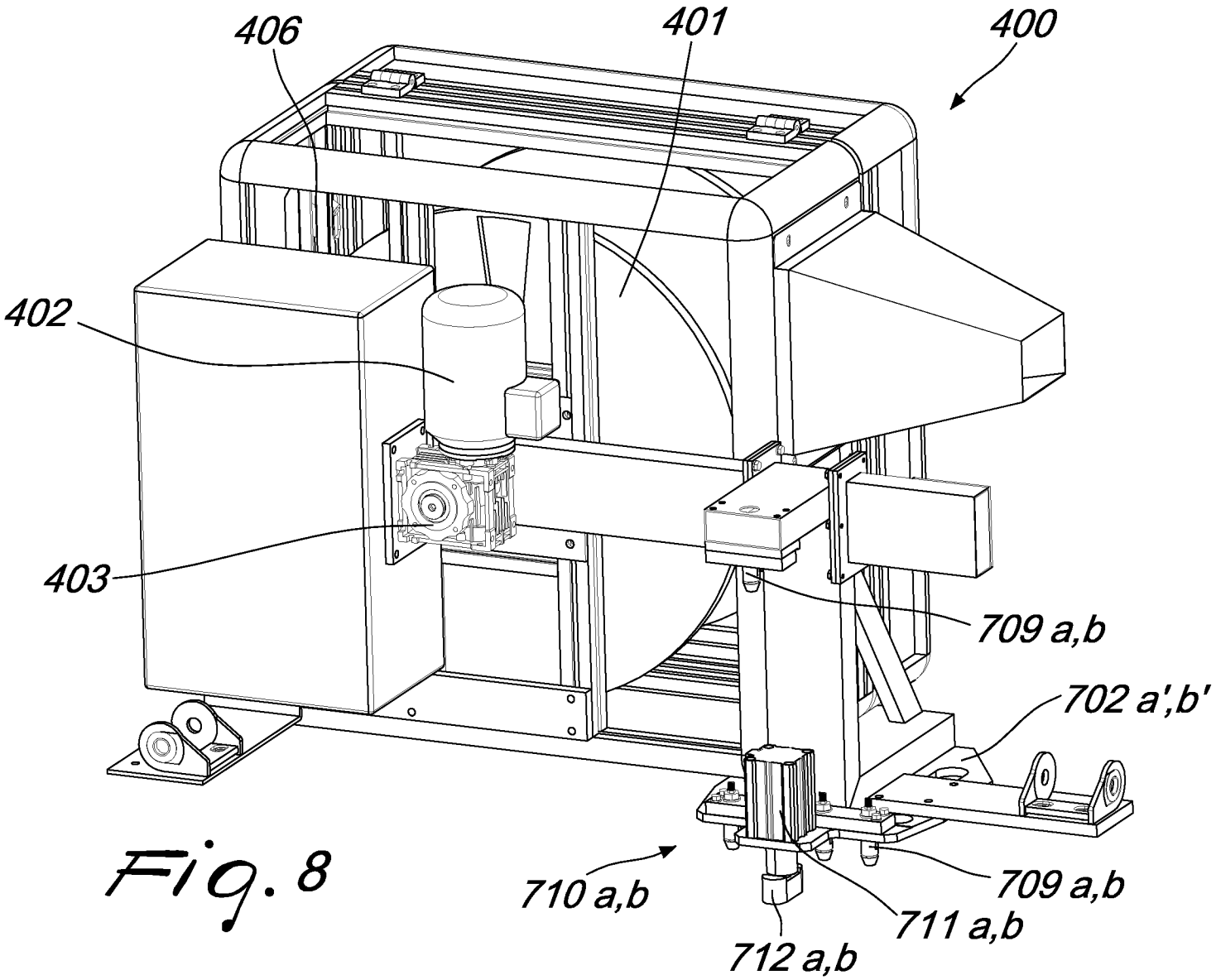
FIG. 8 is a view showing the unit series 400, according to the background art (EP 1 650 396 B1), modified to be compatible with automatic reel changing 401, particularly showing its interfacing with the carriage 201 for the movement of the feeder assembly for approach to (and activation of) the application head and for spacing from the application head so as to swap reels.

FIG. 5 also shows the initial accumulation of the flexible spacer profile 3 is slightly tensioned by winding around the free rollers (303*a*-303*d*), the first of which can oscillate in order to avoid situations of interference between components of the head 300 and components of interface mechanisms such as the transfer unit 600. The accumulation of the flexible spacer profile 3 allows the subsequent rotation of the head through 360° to be performed in four steps in the case of rectangular glazing or in a progressive or combined manner in the case of shaped glazing. This accumulation of the flexible spacer profile 3, combined with the control logic that drives the control of the reel, makes it possible to avoid abnormal tensions in the spacer profile during the rotational transients of the head. This accumulation, in its initial setting position with no reserve of product, enables arrangement of the movable jaw 601 and the fixed jaw 602 (that constitute the hold grippers of the transfer unit 600) downstream of the reels. The corresponding unwinding, control and feedback means and downstream of the film takeup means and upstream of the application head, allow automation for taking the flexible spacer profile 3 from one of the plurality of reels and guiding to the synchronous traction means 304*a* and 304*b*, as illustrated in FIG. 7. One or more of the free rollers 303*a*-303*d* are different from those of the background art in order to allow interfacing with the innovative part of the present invention.

In order to describe an exemplary, but not limiting, way of carrying out the invention, reference is now made to FIGS. 2-5, 17, 18A and 19.

Features of FIGS. 2, 3 and 4 that are not described herein are assumed to be known and therefore not requiring detailed description herein, since they belong both to the prior art described previously and to the knowledge of the person skilled in the art. Nothing is described, for example, in relation to the structure related to synchronous horizontal axis x and the corresponding mechanisms for the grip (by means of a sucker or suckers 101), the synchronous conveyance of the glass sheet, in relation to the synchronous vertical axis y and corresponding mechanisms and in relation to the synchronous axis y and corresponding mechanisms, since these are configurations that are well-known in the field of machines for manufacturing insulating glazing.

Reference numerals with single digits refer to the material being processed, whereas, reference numerals with three digits refer to the components of the machine, and reference numerals having three digits that are multiples of 100 refer to each unit of the machine. Finally, reference numerals with four digits designate the machines upstream and downstream of the machine 1000 of the present invention.

In particular, the flexible spacer profile made of expanded synthetic material is designated by the reference numeral 3, without precluding the operation of the machine 1000 also with spacer profiles made of a different material, so long as it is compatible with the mechanisms that will be described hereinafter. The reference numeral 2 designates the glass sheet [of the at least two or more glass sheets, particularly the one or the ones (in the case of insulating glazing composed of more than two glass sheets) affected by the application of the flexible spacer profile 3]; the reference numeral 1 designates the insulating glazing.

The numeral 11 designates the electrical/electronic panel, the numeral 12 designates the control and interface post and the numeral 13 designates the protective structures, be they of the type of mechanical covers or optical barriers or laser barriers or electrosensitive mats, etc. Particular attention is directed, in addition to the structural, functional, economic and ergonomic aspects, which are peculiar to the contents of the present invention, to the aspects related to the prevention of accidents (more broadly, Health & Safety & Wellness in the work environment).

A preferred but not exclusive way of carrying out the invention is described hereinafter.

A premise that concerns orientations, only for the purposes of the present description, should be kept in mind: when the term "vertical" is used, "slightly inclined with respect to the vertical" is actually intended. In fact, the conveyance of the glass sheet occurs on conveyors, the resting plane of which is "slightly" inclined with respect to the vertical by approximately 6°. Likewise, the lower supporting/transport rollers and belts have an axis inclined by approximately 6° with respect to the horizontal plane, and therefore when the term "horizontal" is used, "slightly inclined (by approximately 6°) with respect to the horizontal" is intended.

The known part of the machine (discussed in detail for example in EP 1 650 396 B1 of the same inventor as the present application) is described initially, but only in its essential aspects. The new and inventive part is thereafter described.

Known Part of the Machine

A glass sheet 2 that arrives from a previous processing machine 4000 (see Figure FIG. 18A) is either loaded manually or by means of a loader onto the input conveyor of the machine 1000 to which the present invention relates. The glass sheet 2 moves forward, conveyed by supporting and traction rollers in the first part and by the supporting and traction belts in the second part (see, FIGS. 2, 3) up to a slowdown sensor and to a stop device, both known, so as to position the glass sheet 2 and allow the beginning of the process of application of the flexible spacer profile 3 against the glass sheet 2.

Figure 6:
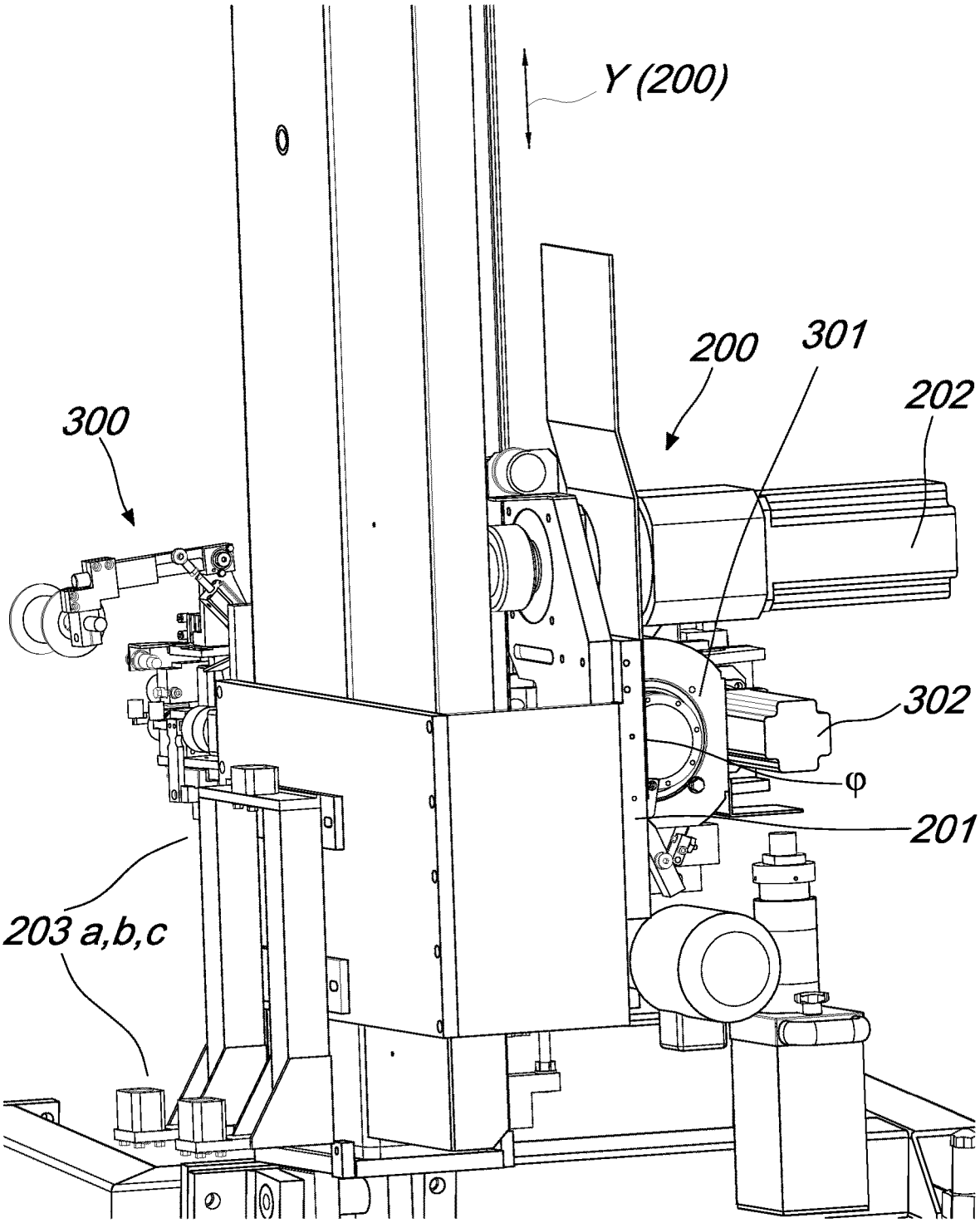
FIG. 6 is a view, from the operator side, of part of the unit series 200 (y axis) and of part of the unit series 300 (φ axis), according to the background art (EP 1 650 396 B1), modified to be compatible with automatic reel changing, particularly including the engagement means 203*a*, 203*b*, 203*c* of the supply assembly defined previously, so as to jointly connect the supply assembly with the carriage 201 of the unit 200.

Referring to FIGS. 2 and 6, in a process start step, the head assembly 300 is attached to the vertical carriage 201 and configured to move vertically through the action of a synchronized motor 202 and a reduction unit, which actuate a pinion which, in turn, acts on a rack and through the actuation of another synchronized motor 302 which acts by means of adapted transmission elements on the rotation of the hollow shaft 301.

The spacer profile 3 is guided through the series of free rollers 303*a*-303*d* and the additional free rollers shown in FIGS. 5 and 7, which interact with the faces of the spacer profile that lie at right angles to the plane of the glass sheet 2. The spacer profile 3 is also guided by means of a series of free rollers and by complementary rollers which are also free where indicated in the figures, interacting with the faces of the flexible spacer profile that lie parallel to the plane of the glass sheet 2. The guided spacer profile is engaged with the belt driving device 304*a* and 304*b* actuated by synchronized motors 305*a* and 305*b*, and is pushed by the wheel 306 against the glass sheet 2, after the axial approach of the head 300 performed by means of a motor and a reduction unit which interact on a mechanical transmission, guides and sliders which are shown, partially, in FIG. 5.

The synchronized motion of the glass sheet 2, actuated by a synchronous synchronized transmission means 101 with a synchronized motor 102, as shown in FIG. 2, that acts by means of a reduction unit and mechanical transmission of the pinion/rack type on a sucker which can move on a carriage and guides (and through the action of a parallel mechanical conveyor with rollers and/or with belts which acts on the lower edge 2*a* of the glass sheet 2) and the synchronized motion of the belt transmission device 304*a* and 304*b* produce the mutual flexible spacer profile/glass sheet path that corresponds to the first lower side 2*a* of the glass sheet 2.

Figure 9:
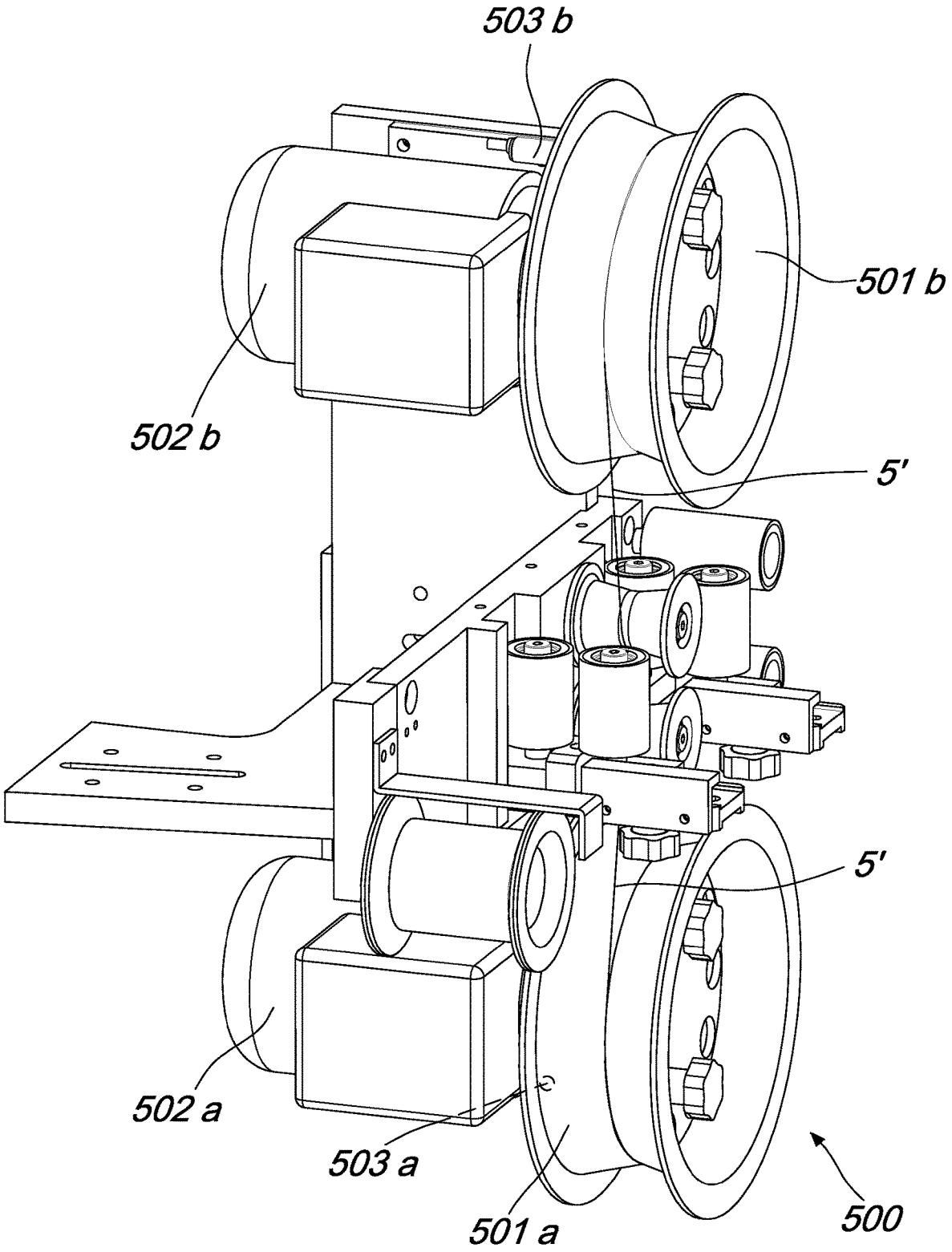
FIG. 9 is a view showing the unit series 500, according to the background art (EP 1 650 396 B1), modified to be compatible with automatic reel changing and movable jointly with the units 400 and 600, since because it can be interfaced with the carriage 201.
Figure 10:
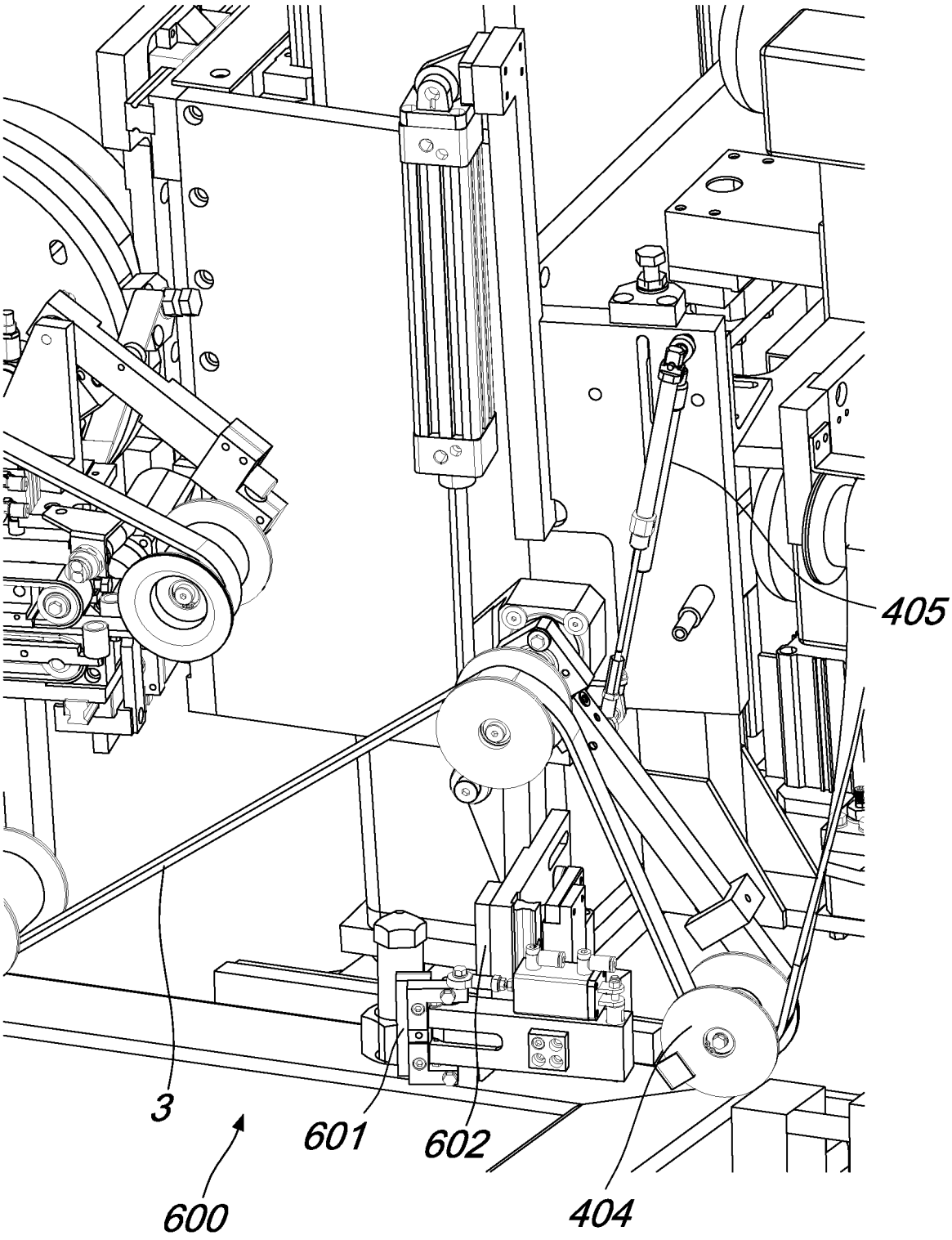
FIG. 10 is a view illustrating the new and inventive unit series 600, which relates to the movement for feeding the flexible spacer profile 3 from each one of the reels of the magazine series 400, through the unit 500 to the application head series 300 integral with the carriage 201. The operating condition illustrated here is with the application head 300 that performs the process of depositing the spacer profile 3 on the glass sheet 2, and therefore feeding the spacer profile 3 to the application head 300 has already occurred and the feeding mechanisms 601, 602 and corresponding actuators are in the inactive condition.
Figure 11:
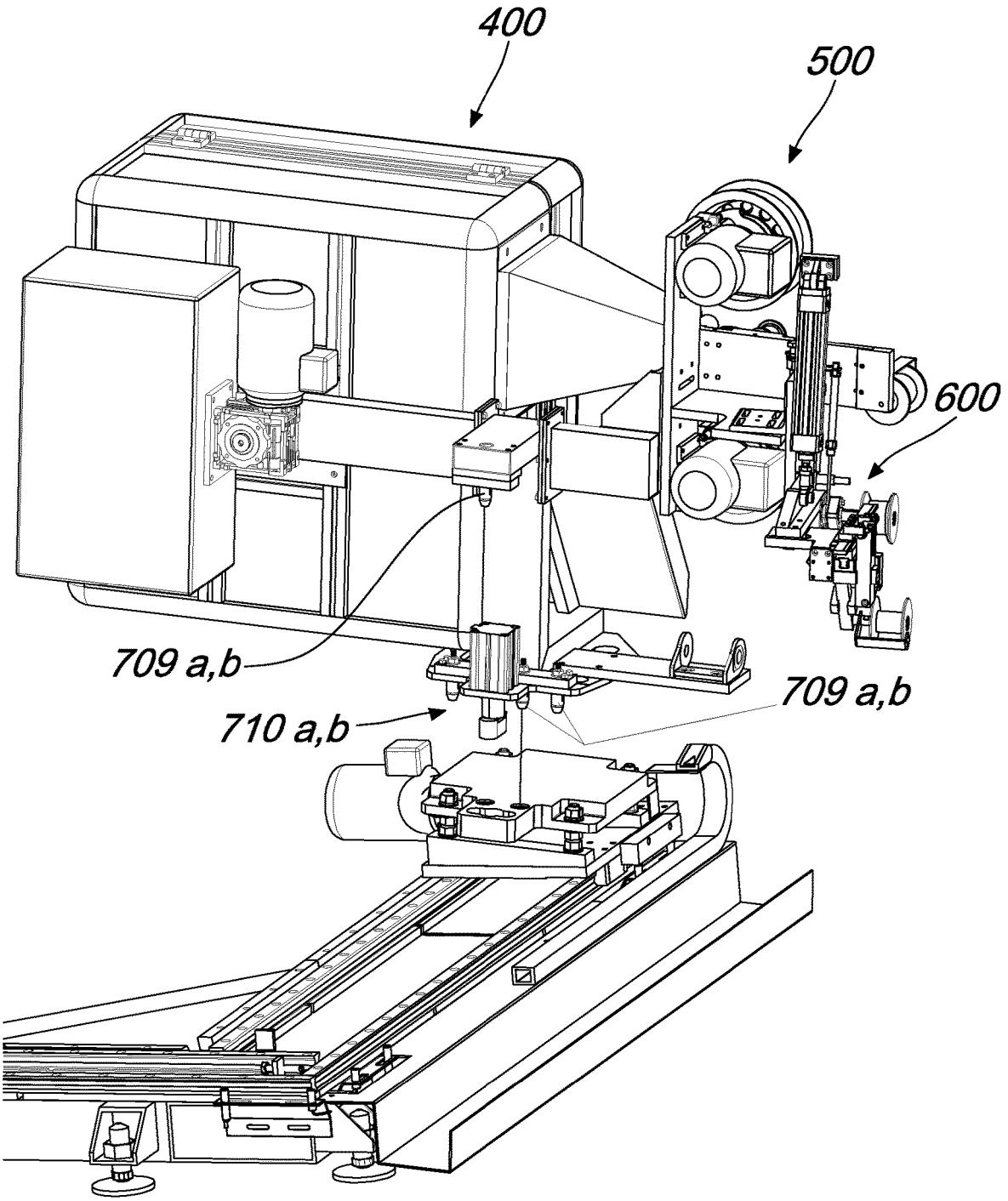
FIG. 11 is a view illustrating the footing, including at least two carriages, which are moved by means of gear motors and on which the units 400, 500, 600 are coupled, that constitute the feeder assembly (shown raised to illustrate the centering pins and locking mechanism), adapted to feed the application head series 300 with the spacer profile 3 with the possibility to alternate reels and therefore the types of spacer profile 3.
Figure 12:
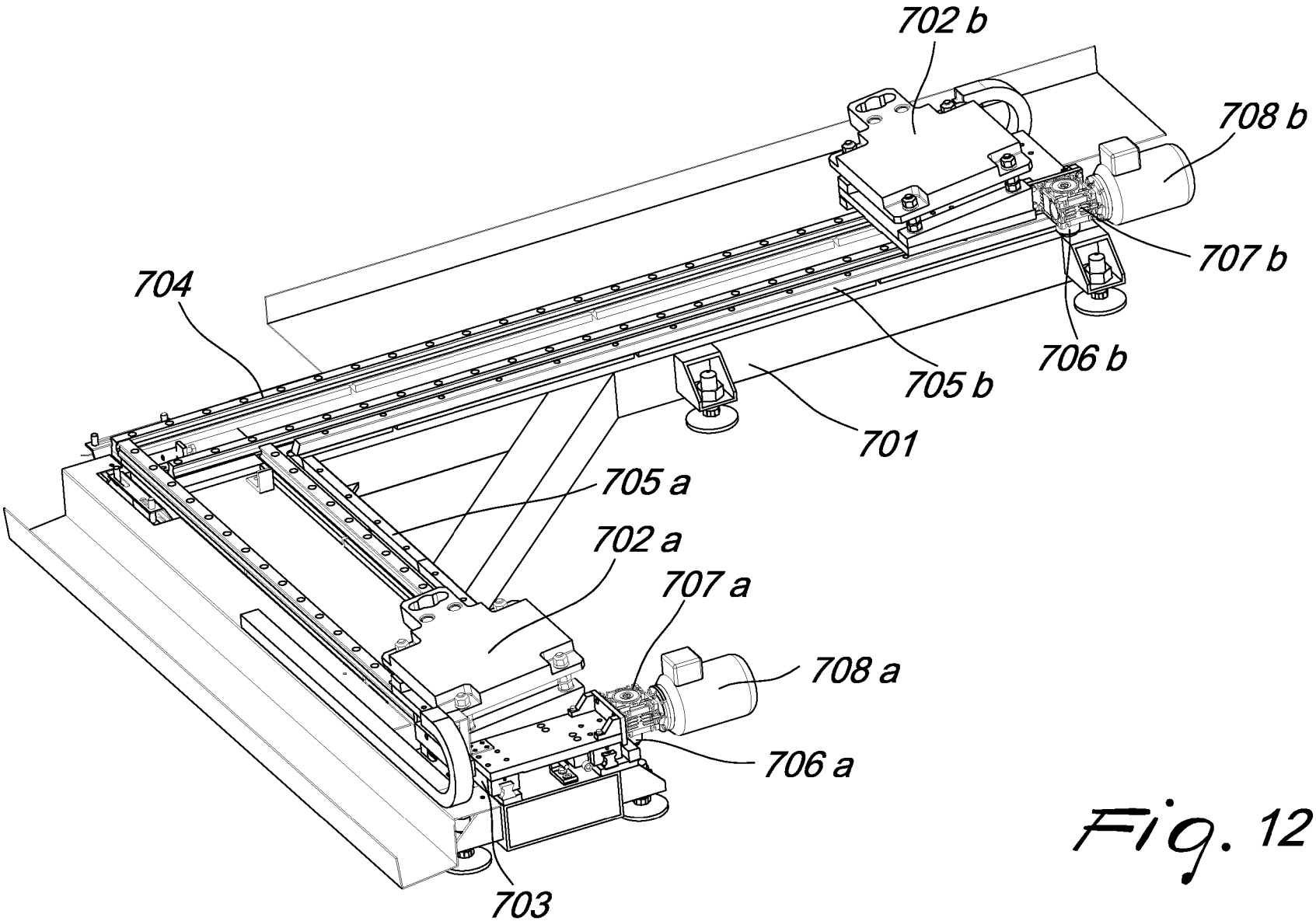
FIG. 12 is a view showing the constructive details of the footing 701 and the carriages 702*a*, 702*b* for moving the feeder assemblies and numbers them in detail.

In order to allow the application of the flexible spacer profile 3 against the glass sheet 2 without the various devices of the head 300 contacting the glass sheet 2 and the spacer profile 3, the arrangement of the head is slightly inclined with respect to the plane of the glass sheet 2 and the head is provided with the axial motion described previously in order to eliminate interference with the flexible spacer profile 3 once it has been applied, as shown in the various figures. In this step, the reel 401 (see, FIGS. 5 and 8), the rotation of which is actuated by the non-synchronous motor 402, which acts by way of the reduction unit 403, provides the flexible spacer profile 3 on demand because the motor 402 receives as feedback the position of the dandy roll 404 which interacts with the potentiometer 405, which is arranged downstream of the unwinder of the reel, for the aim of greater functionality in the unit 600 in FIGS. 10, 13, and 14. The dandy roll 404 and the potentiometer 405 perform feedback and fine control, while the sensor 406 supplies information on the diameter of the reel for the coarse control of the peripheral speed range of the reel. Also during this step, the films 5' (see, FIG. 1G) that protect the lateral faces of the spacer profile 3 are conveniently removed from the winders 501*a* and 501*b* actuated by the respective motors 502*a* and 502*b* coupled directly thereon, the electronic actuation of which is simply with torque control (see, FIGS. 9 and 13). Feelers 503*a* and 503*b*, which interfere with the films, stop the machine in case of breakage or otherwise of malfunctions affecting the films. More conveniently, as an alternative to the feelers, as shown in FIG. 9, sensors 503*a* and 503*b* are used which detect the overspeed of the winders or of one of the winders when they are no longer contrasted by the traction of the film because it is broken.

The management of the position of the glass sheet 2, particularly of its initial placement, is fundamental for the correct functioning of the process performed by the head 300, both in the rectangular version and in particular in the shaped version, for coordinating the horizontal movement of the glass sheet 2 and the vertical movement of the vertical carriage 201 that carries the head 300. In the case of a glass sheet 2 having a rectangular shape, one or more sensors (known and therefore not shown) detect the position of the edge of the glass and, by means of the logic of the PLC, give information that is useful for following the rectangular perimeter of the glass sheets 2, respectively for the actuations of the traction rollers, of the traction belts, of the sucker 101 for horizontal movement x, or for the actuation of the vertical movement of the vertical carriage 201 and for the actuation of the belt driving device 304*a* and 304*b* (see, FIG. 7).

In the case of a glass sheet 2 that has a contoured shape, i.e., a nonrectangular shape, the information related to its shape is entered electronically with known techniques, and besides the actuations described earlier, which act on the synchronous synchronized motors for actuating the traction of the glass sheet 2, the movement of the vertical carriage 201 and the traction of the spacer profile 3 by means of the traction devices 304*a* and 304*b*, the actuation of the synchronized motor 302 that actuates the rotation of the head 300 about the axis φ is also involved so that the four motions, horizontal x of the glass sheet 2, vertical y of the head 300, rotary φ of the head 300, and translatory of the belts 304*a* and 304*b*, are electrically/electronically linked in order to follow the shape of the glass sheet 2.

Once the execution of the first lower side 2*a* of the glass sheet 2 has ended, the head 300 performs a rotation as a whole (through 90° in the case of the rectangular sheet), due to the action of the synchronized motor 302, the reduction unit, the toothed belt transmission, which act on the hollow body 301 of the head 300. As a consequence, the flexible spacer profile 3 has an orientation which is parallel to the second side 2*b* of the glass sheet 2 which has a vertical arrangement. This step of rotation entails both a restitution of the flexible spacer profile 3 and a demand of the films 5' which, respectively, the reel actuation assembly or unwinding unit 400 will take up, since the motor 402 is reversible, by means of the signal of the dandy roll 404 and the corresponding inverse feedback provided by the potentiometer 405, while the film takeup unit 500 will return the films 5', the corresponding motors 502*a* and 502*b* with torque control being able to reduce the torque until they become free, or rather still slightly actuated in order to maintain a minimum preloading on the films 5'.

For depositing the flexible spacer profile 3 on the vertical side 2*b* of the glass sheet 2, the sequences described for side 2*a* are repeated, except that instead of the glass sheet 2 being translated horizontally along the axis x, the head 300 translates vertically along the axis y by means of the actuation that acts on the synchronized motor 202 that actuates the slider 201.

The continuation of the sequences for completing the deposition of the spacer profile 3 on the glass sheet 2 along the remaining part of the perimeter (sides 2*c*, 2*d*) is merely the alternation of the steps described for the sides 2*a* and 2*b*.

Likewise, all the operations and corresponding devices for the prismatic die-cutting of the spacer profile 3 at the positions that will become corners of the spacer frame and for the final die-cutting for parting, performed by the blade 307 at what will become the last corner, are assumed to be known (as detailed in EP 1 650 396 B1).

All of the movements connected to the steps of the cycle are mutually interlocked, by the aid of a logic system which is parallel but always active, in order to avoid, during the process, conditions of mutual interference between actuation elements and material being processed and in order to control the safety functions of the machine, even in case of interruption of the electric and/or pneumatic supplies.

Inventive Part of the Machine

At this point a description of a preferred, but not exclusive, embodiment of an inventive part of the present invention is hereinafter provided.

An inventive part of the present invention is a modification to the configuration of the application head, disclosed in EP 1 650 396 B1. In the modified configuration, a spacer profile 3 winds around the end part of the application head 300 by means of the series of rollers 303*a*-303*d* while it does not cross the hollow shaft 301 that supports the head 300, to a feed that no longer comes from a single reel but from a plurality of reels, which are arranged in their inactive position on a deck which is fixed to the floor. The reels are coupled couplable alternately to the vertical carriage 201 in their active position, i.e., for feeding the application head 300 in the step of deposition on the glass sheet 2.

Since the feeding of the flexible spacer profile 3 occurs along a plane which is pseudo-parallel to the glass sheet 2, it is possible to reach, with the mechanisms of the unit 600 for transferring the spacer profile 3 from the known units, 400 for unwinding and 500 for removing films, up to the vicinity of the traction mechanisms 304*a*, 304*b* of the application head 300.

FIG. 5 illustrates the condition of initial application of the flexible spacer profile 3 on the side 2*a* of the glass sheet 2, which is obtained from the conditions of FIG. 7, (after capturing the spacer profile 3 fed by the feeding mechanisms of the unit 600 to the traction mechanisms 304*a*, 304*b* of the unit 300 and made to advance to the set sensor 308, aligned with the blade 307 for the final cutting of the spacer profile 3, as shown in FIG. 7, and after having performed a rotation through 360° of the application head about the axis φ y in a clockwise direction (reference with the shoulders on the glass sheet). The conditions of end of the application are the same as in Figure FIG. 5, but after the application head 300 has performed a counterclockwise rotation through 360°. (reference with the shoulders on the glass sheet).

Figure 14:
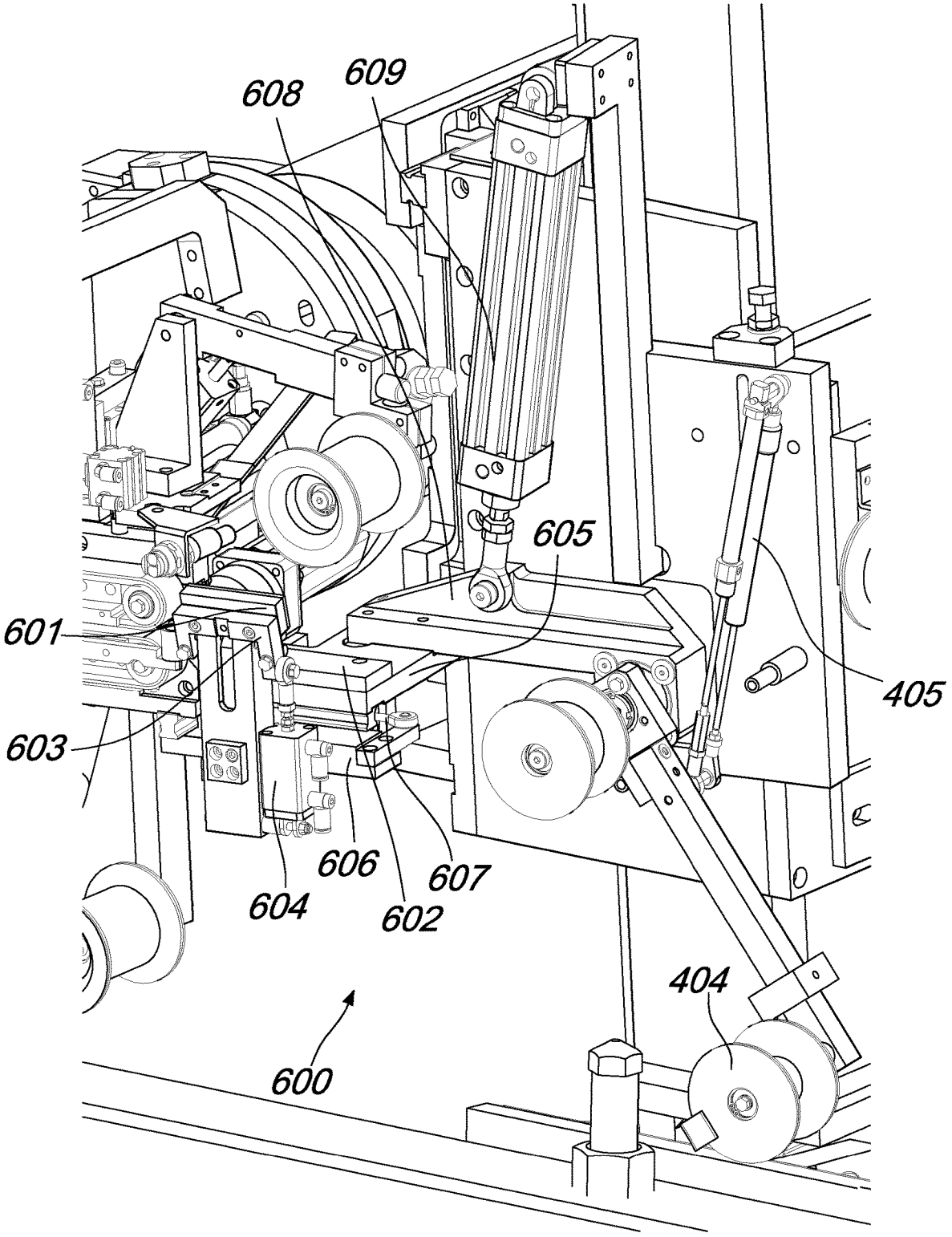
Figure 15:
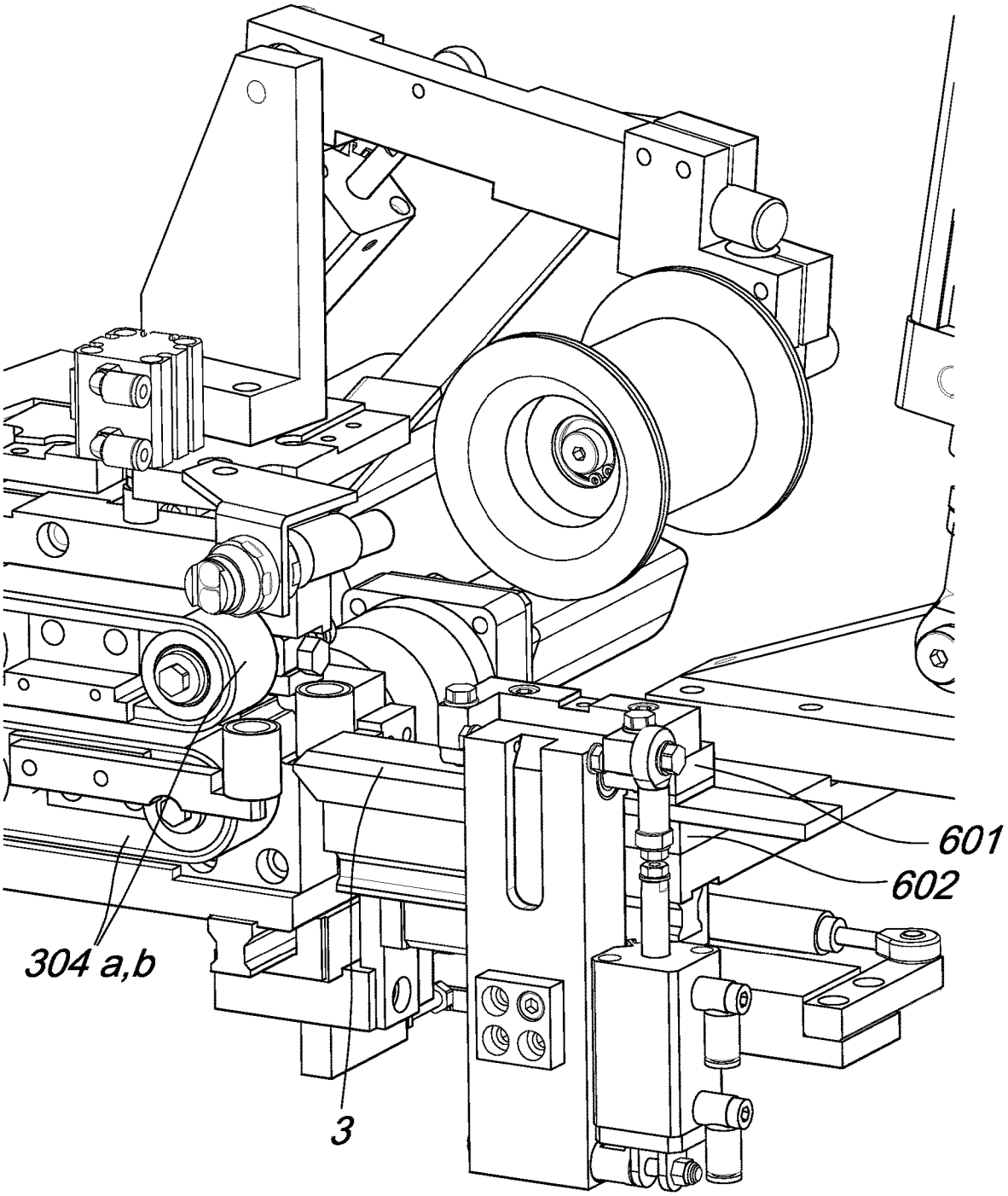
FIGS. 15 and 16 are views illustrating the conditions for gripping the end of the spacer profile 3 before its transfer and after the transfer has been completed from the feeder assembly (combination of the units 400, 500 and 600) to the synchronous traction means 304*a* and 304*b* of the application head 300.
Figure 16:
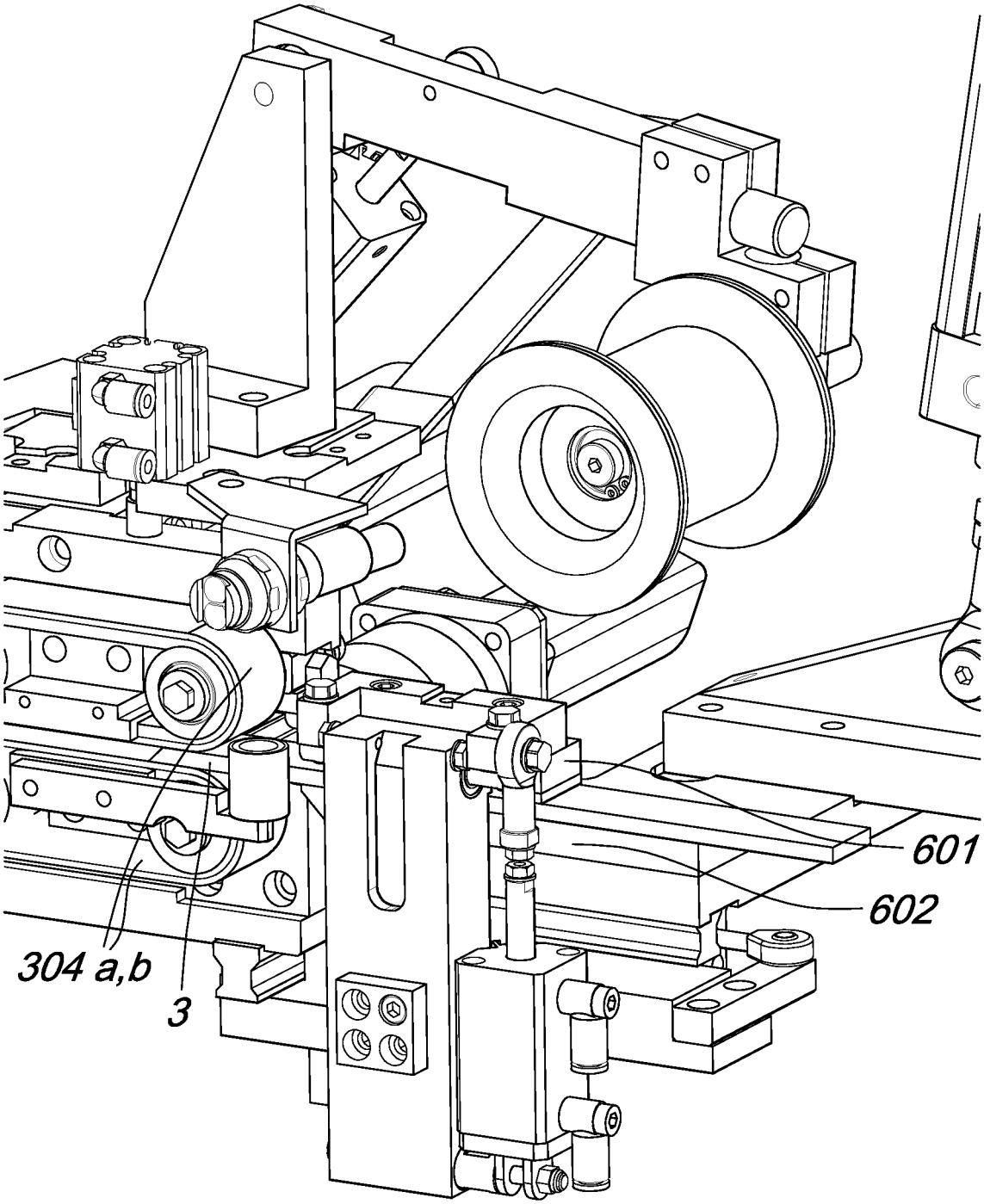
Figure 17:
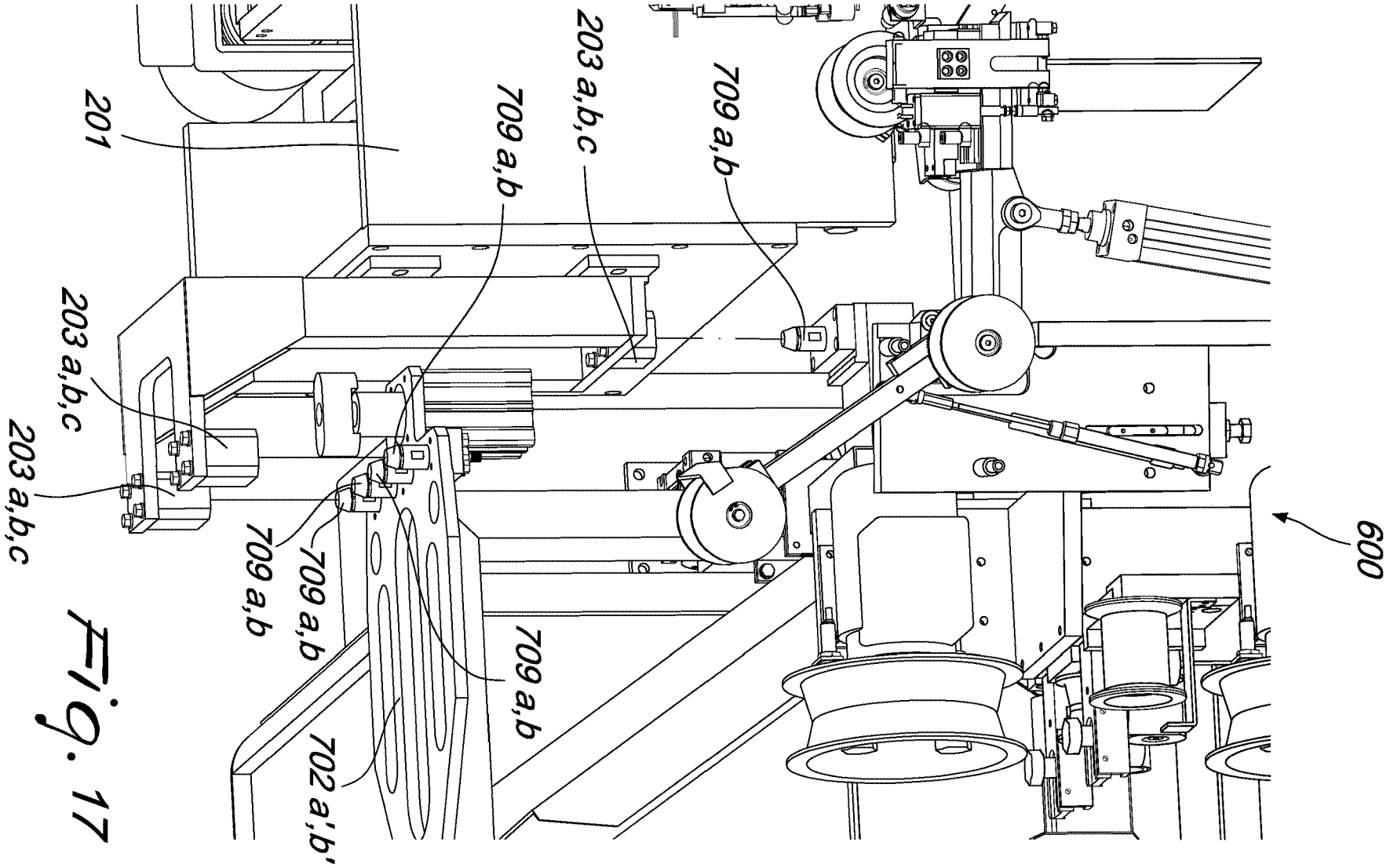
FIG. 17 is a view of the system for coupling the feeder assembly (combination of the units 400, 500 and 600) to the vertical carriage 201 of the series 200 and of the system for coupling the feeder assembly (combination of the units 400, 500 and 600) to the slider of the reel magazine. In order to identify and describe these systems, the numberings take the series 200 if applied to the carriage 201 and the series 700 if applied to the magazine. The unit 600 is shown spaced from its natural position only to show engagement means, such as bushes 203*a, b, c* and pins 709*a, b* used for coupling a respective feeder assembly 400, 500, 600 to the carriage 201. The apparent interference on the left part, therefore, should be ignored.

FIGS. 15 and 16 are views, respectively, of the condition of waiting to transfer the flexible spacer profile 3 on the part of the extension 600 of the feeder assembly (combination of the units 400, 500 and 600) to the conveyors 304*a*, 304*b* and of completed transfer. Both figures are views from the side of the glass sheet (i.e., with the shoulders resting on the sliding plane of the glass sheet 2, illustrated in FIG. 2). FIGS. 10 to 17 contain the details and the corresponding numberings of inventive parts.

The operation for the replacement of a flexible spacer profile 3 with another flexible profile, designated by 3', is hereinafter disclosed as occurs in succession, with reference to the situation in which this occurs once the laying of the previous flexible spacer profile 3 on a glass sheet 2 has been concluded in order to form the insulating glazing 1 together with one or more other sheets 2. To illustrate the functional steps, when reference is made to the movements obtained by the action of pneumatic actuators (hereinafter termed cylinders), the following nomenclature shall be used: a positive stroke is obtained by the introduction of compressed air in the chamber without the stem of the pneumatic cylinder; a negative stroke is obtained by the introduction of compressed air in the chamber with the stem of the pneumatic cylinder.

Replacement of a flexible spacer profile 3 with another flexible profile 3' occurs as follows:

The head 300 is in the conditions for receiving the subsequent spacer profile 3', because the vertical carriage 201 is arranged in the lower zero position, and in the condition of alignment between the plane of the lower conveyor of the two conveyors 304*a*, 304*b* that act proximate to the lower side 2*a* of the glass sheet 2 and the upper plane of the fixed jaw 602, as shown in FIG. 7 (assuming that the application head 300 is coupled to the carriage 201 which has moved down to its lower stroke limit), but still with the previous spacer profile 3 disposed in the traction elements 304*a*, 304*b* and extended to the final cutting blade 307 and sensor 308.

The rollers 303*a*-303*d* do not contain the spacer profile 3.

The flexible spacer profile 3 is extended up to the crossing of the traction elements 304*a*, 304*b* and up to the reference of the blade 307, and the corresponding sensor 308 for example of the fiber-optic type, which has performed the final cutting of the spacer profile 3 applied to the glass sheet 2 to constitute the previous insulating glazing 1, as a position of readiness to perform the application cycle on the glass sheet 2 to constitute the subsequent insulating glazing 1, a situation which occurs in the series production of insulating glazing units 1 all composed with the same type of spacer frame 3, albeit with any shapes and dimensions of the glass sheets 2.

This preset is cancelled, which would be the one for starting the cycle for the production of a subsequent insulating glazing 1, if it had the same type of spacer profile 3 as the previous insulating glazing 1, in order to reproduce it exactly but with a new flexible spacer profile 3', and proceeds as follows.

Reverse actuation of all the motor drives involved in the movement of the flexible spacer profile and precisely: the motor 402 (FIG. 8); the motors 502*a*, 502*b* (FIG. 9), even if this occurs simply by reducing the torque and leaving the films 5' to actuate the reverse rotation of the winders 501*a*, 501*b* and therefore of the motors; the motors 305*a*, 305*b* that actuate the traction elements 304*a*, 304*b* (FIG. 7).

In these conditions, the flexible spacer profile 3 is rewound on the reel 401 and the film 5' taken from the winders 501*a*, 501*b* is redistributed, albeit coarsely, on the sides 3*p*, 3*s* of the same spacer profile 3 starting from the initial condition in which the sensor 308 (generally of the fiber-optic type) arranged on the application head, at the known blade 307 for the final cutting of the spacer profile, has kept control of the position of the trailing part of the flexible spacer profile 3 in its alignment and, upon emission of its signal of confirmation the motors 305*a*, 305*b*, which are synchronous and therefore measure the movements, which actuate the traction elements 304*a*, 304*b*, activate the takeup of the spacer profile again by retaining it between the transmission belts (which are visible and numbered in FIG. 7 as 304*a*, 304*b*) until the cantilevered part thereof with respect to the fixed jaw 602 corresponds to such a value that subsequently it retracts because it is aligned with the end part of the fixed jaw 602, due to the action of the positive stroke of the cylinder 607 that moves the movable jaw 601, so as to avoid any interference between the spacer profile 3 and the application head 300.

During the previously described steps, the movable jaw 601 was in the open position with respect to the fixed jaw 602 due to the action of the cylinder 604, which had performed its negative stroke, the slider 606 was in the advanced position with respect to the application head 300 due to the action of the pneumatic cylinder 607 that had performed its negative stroke, and the plate 605 was in a spaced position with respect to the application head 300 by rotation of the arm 608, actuated by the pneumatic cylinder 609 that had performed its positive stroke and therefore the application head 300 was free to rotate for the functions of laying the spacer profile 3 against the glass sheet 2.

Figure 13:
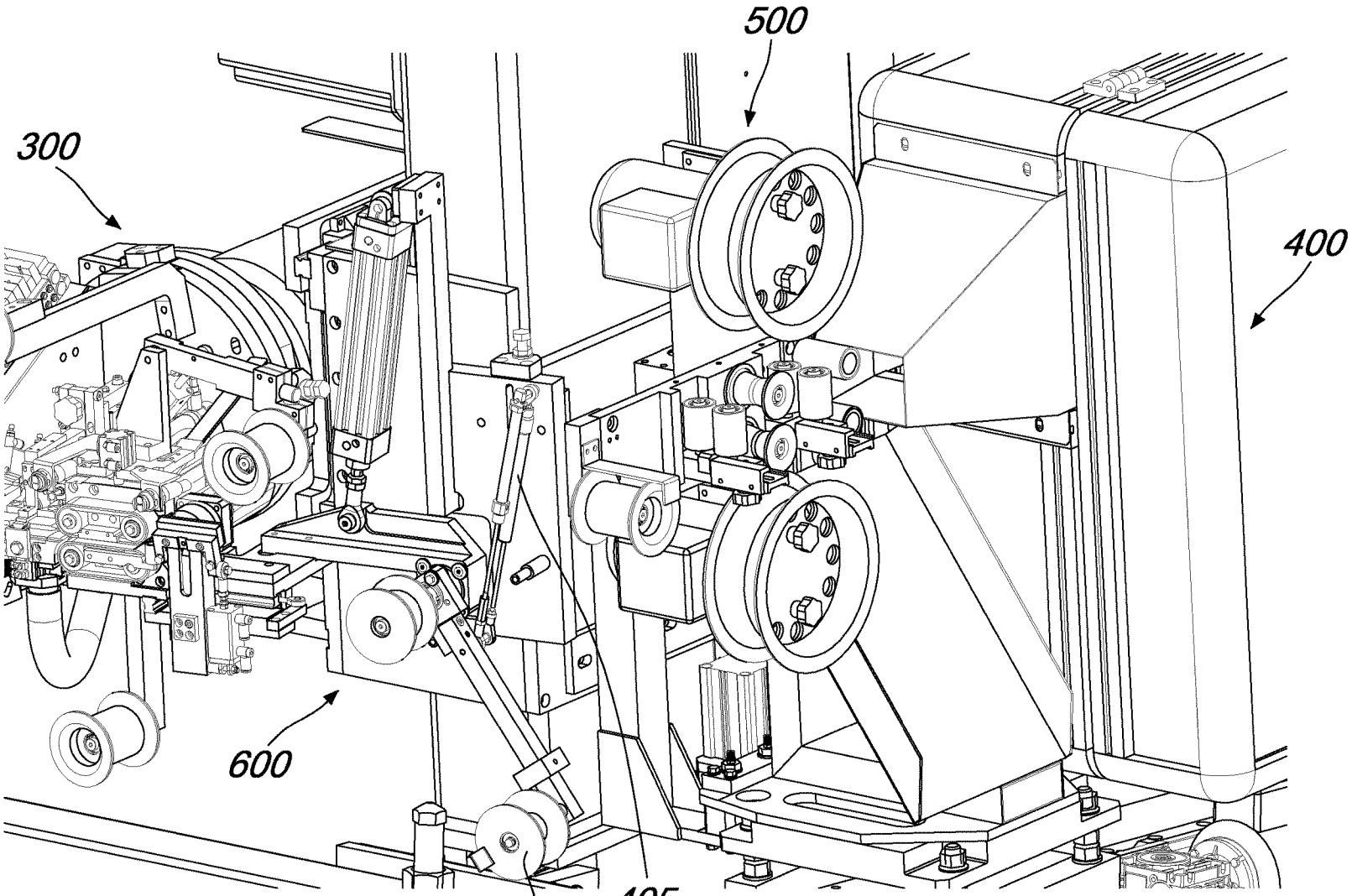
FIGS. 13 and 14 are views illustrating the operating conditions of interaction between the feeder assembly (400, 500, 600) and the application head 300.

At this point the plate 605 is moved adjacent to the application head 300, shown in FIGS. 7, 13, and 14, due to the action of the cylinder 609, which performs its negative stroke, making the arm 608 rotate. The movable jaw 601 is therefore closed against the fixed jaw 602 due to the action of the pneumatic cylinder 604, which performs its positive stroke, making the arm 603 rotate, then the movable jaw 601 is moved away from the extrusion head 300 due to the action of the pneumatic cylinder 607, which performs its positive stroke, thus moving away the end portion of the spacer profile 3 from the synchronous transmission means 304*a*, 304*b* and other bulks of the application head 300, thanks to because of the high friction of its active surface and low friction of the sliding surface of the fixed jaw 602.

Next the feeder assembly constituted by the units 400, 500 and 600 and the spacer profile 3, for its part wound around the reel 401, and for its unwound part up to the retention jaws 601 and 602 present therein, are disengaged from the application head 300 and can be guided to the standby position of the magazine series 700, after rotation of the lever 608 actuated by the cylinder 609 in order to avoid interference with the carriage 201.

This is obtained by activating the following additional mechanisms:

- lowering of the vertical carriage 201 so that after the resting of the plate 702*a'* for supporting the feeder assembly 400, 500, 600 against the standby plate 702*a* arranged in the position for receiving the plate 702*a'* the additional downward stroke of the carriage 201 entails the disengagement of the engagement means that can be provided in a non-exclusive embodiment, as supporting bushes 203*a*, 203*b*, 203*c* that belong to the carriage 201 from corresponding pins 709*a* which are jointly connected to the plate 702*a'* (FIG. 17); activation of the locking device 710*a* activated by the cylinder 711*a* so that the butterfly 712*a* jointly connects the plates 702*a* and 702*a'* (FIGS. 11 and 17); and
- actuation of the motor 708*a* which, by means of the reduction unit 707*a*, the pinion 706*a* and the rack 705*a*, moves the feeder assembly 400, 500, 600, moving it away from what was the position for engagement with the application head 300 to the standby position of the magazine 700; the movement of the plate 702*a* when unloaded and of the assembly of the plate 702*a*, the overlying plate 702*a'* with corresponding feeder assembly 400, 500, 600 is limited by slowdown and stopping sensors in the two directions of motion.

Once a feeder assembly is in its stand-by position, the other feeder assembly, due to the action of all the similar corresponding mechanisms 702*b*-712*b* can migrate from the standby position to the active position, i.e., the position for engagement with the application head 300, in order to actuate the manufacturing process of the insulating glazing 1 not with the spacer profile 3 (for example with dimensions of 5 mm×12 mm and colored black) but with the spacer profile 3' (for example with dimensions 5 mm×20 mm and colored gray).

For the engagement of the new feeder system with the application head 300 all the mechanisms of the slider 201, the mechanisms of the components of the assemblies 400, 500, 600, as well as the mechanisms of the components of the application head 300 perform the reverse steps with respect to the ones described originally. In particular, the sensor 308 (generally of the fiber-optic type) stops the actuation motors of the translation units 304*a*, 304*b* so that the head of the new spacer profile 3' stops in a precise position for starting the application on the lower side 2*a* of the glass sheet 2.

At this point, the application head 300 rotates clockwise through 360° (reference with the shoulders on the glass sheet), so as to accumulate along the path defined by the free wheels 303*a*-303*d* the quantity of spacer profile 3 adapted to allow the rotation of the application head in following subsequently the perimeter of the glass sheet 2.

The preferred embodiment is susceptible to numerous constructive variations. Thus, for example, the person skilled in the art may find equivalent solutions for the mechanical means for the displacement motions of the apparatuses, the support and traction of the glass sheets 2 along the axis x, the vertical motion of the head 300 coupled to the carriage 201 along the axis y, the rotation of the application head 300 along the axis φ et cetera, the mechanical means for the continuous or discontinuous movements of the spacer profile 3. Also the actuation means may be electrical, electrical-electronic, pneumatic, hydraulic and/or combined, et cetera, the control means, may be electronic or fluidic and/or combined, et cetera.

A process and constructive variation, partially already described, is the one constituted by the logic combination of the actuation systems respectively for horizontal translation of the glass sheet (unit 100), for vertical translation of the head coupled to the carriage 201 (unit 200), for rotation of the head (unit 300) and for translation of the belts of the belt transmission devices 304*a*, 304*b*, so as to allow the application of the spacer profile 3 on glass sheets 2' that have shapes other the rectangular one, (see FIGS. 18B-18E). These shapes may be a regular or an irregular polygonal shape. The application may be on glass sheets 2" that have a shape other than the rectangular one, such as that constituted by curvilinear parts, or on glass sheets 2'" that have a shape other than the rectangular one being, for example, constituted by both linear and curvilinear parts.

In order to obtain these, as completion of what has been described previously, the electric actuation systems of the motors or pair of motors 102, 202, 302, 305*a*, 305*b* will be concatenated by means of an electric axis (numeric control).

The constructive details can furthermore be replaced with other technically equivalent ones. The materials and dimensions may be any according to requirements, in particular those arising from the dimensions (base and height) of the glass sheets 2 and therefore of the insulating glazing 1. The machine can have a direction of work that is opposite to the one described and illustrated in the figures, or L-shaped or U-shaped, with no need for additional explanations.

Machines for the automatic application of the flexible spacer profile 3 made of expanded synthetic material on glass sheets 2 currently are not widespread, but are nevertheless substantially present and required. Use of the flexible spacer profile 3 made of expanded synthetic material, because of its technical and technological characteristics (particularly the low coefficient of heat conductivity) and its applicability also in manual or semi-automatic version is also highly required. Moreover, the use of insulating glazing 1 is expanding continuously, since in recent years it has been increased by all those configurations that require the use of special and therefore heavy glass, such as the ones described in the introduction (and in particular the very thick ones, such as toughened glass and in particular combinations of more than two glass sheets), which are thus coupled advantageously from the very first mating by means of the spacer frame, if it is of the type to which the present application relates, unlike the conventional type, which requires the catalysis of the second sealant before the glass-frame joint can be stressed with mechanical loads.

An essential concept, introduced only herein, is to render flexible, in the sense of alternable, the use of a plurality of types, thicknesses and colors of the flexible spacer profile 3 made of expanded synthetic material by means of a simple and reliable automation that allows quick transition from one profile to another. This was already taken for granted in the case of the spacer profile 3 made of rigid material (albeit very complex in the case of complete automation) but was not yet possible in the case of a spacer profile 3 made of expanded synthetic material except manually and at the expense of a waste of material and of an excessive use of time and in particular at the expense of productivity, since it was necessary to stop the process of production of the insulating glazing during the considerable time required to replace the reel 401. Such requirement is in fact current in the production of insulating glazing in which product merges are highly various even for a single user, to the point of reaching variability even within the same unit of insulating glazing 1 when it is constituted by more than two glass sheets 2 and therefore by more than one flexible spacer frame 3 if it is required. Although not systematical but in any case frequent, it is that the unit of insulating glazing has spacer frames with different characteristics, for example in order to improve soundproofing performance or to achieve adaptation to the type of door or window frame desired or for the choice of colors, et cetera.

Figure 18A:
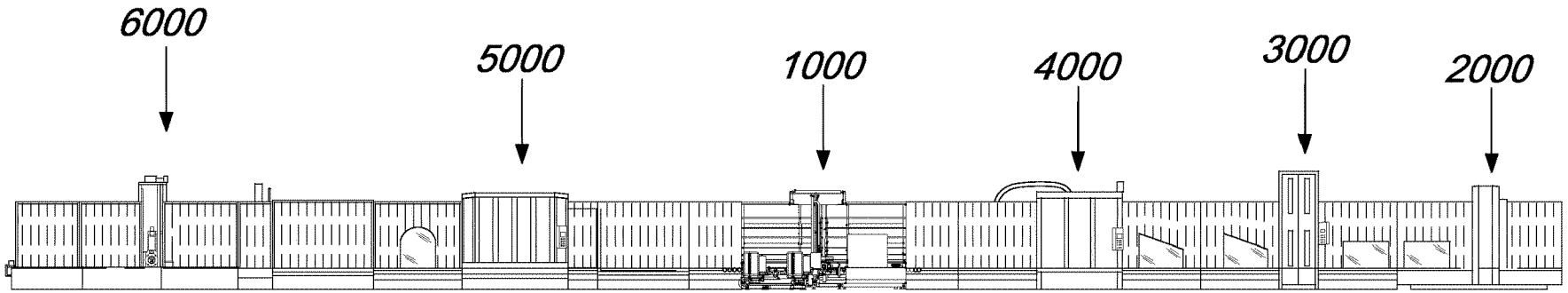
FIG. 18A is a perspective view illustrating an example of insertion of the machine 1000 in the production line of the insulating glazing 1 and does not include: electrical/electronic panel, control post and protection devices.
Figures 18B, 18C, 18D, 18E:
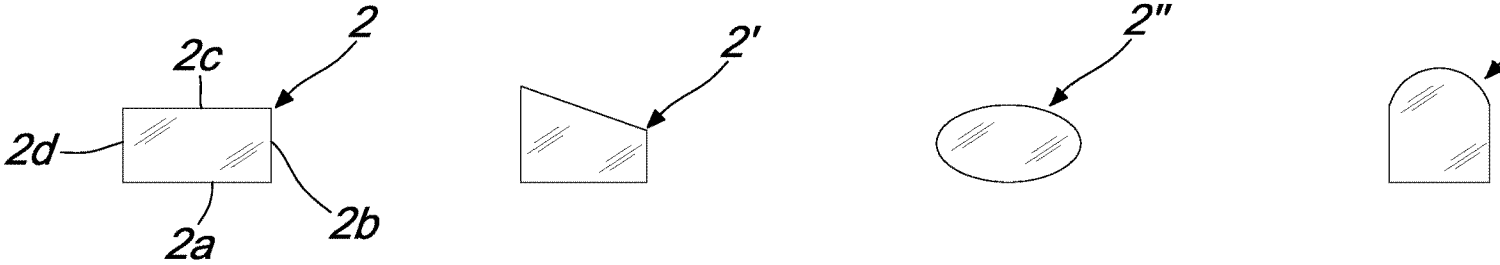
FIGS. 18B-18E show glass sheets, with different shapes that can be used for insulating glazing made according to the invention.
Figure 19:
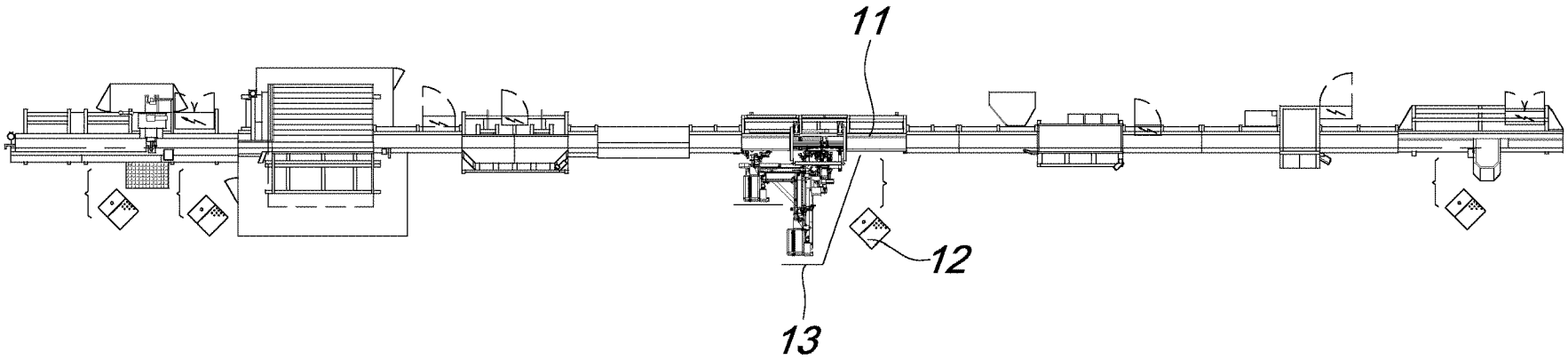
FIG. 19 is a plan view illustrating an example of insertion of the machine 1000 in the production line of the insulating glazing 1 and includes: electrical/electronic panel, control post and protection devices.

Insertion of the machine, according to the present invention in the production line of insulating glazing is illustrated in FIG. 18A and. Advantageously, the machine according to the present invention can be implemented on existing production lines of insulating glazing 1.

The disclosures in Italian Patent Application No. TV2011A000102 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

What is claimed is:

1. An automatic machine (1000) for applying a flexible spacer profile (3) on at least a first glass sheet (2) mateable with at least a second glass sheet (2) so as to constitute an insulating glazing (1), the machine (1000) comprising:

a plurality of reels (401), each reel (401) containing a respective flexible spacer profile (3);

a conveyor (100) supportingly engageable with a lower edge (2*a*) of the first glass sheet (2) and able to move the first glass sheet (2) along a horizontal axis (x);

a carriage (201) movable in translational motion along a vertical axis (y); and an application head (300) coupled to and movable with the carriage (201) and rotatable about a rotational axis (φ) perpendicular to the vertical axis (y) of the carriage (201), the application head (300) having a belt drive (304*a*, 304*b*) engageable with the flexible spacer profile (3) and free rollers (303*a*-303*d*) arranged to guide the flexible spacer profile (3) arriving from one reel (401) of the plurality of reels (401) towards a wheel of the application head (300);

wherein each reel (401) of the plurality of reels (401) is provided with a respective feeder assembly (400, 500, 600) for each of the respective flexible spacer profiles (3), each feeder assembly comprising a reel unwinding unit (400), a take-up unit (500), and a transfer unit (600), wherein the transfer unit (600) guides the flexible spacer profile (3) to and from the belt drive (304*a*, 304*b*) of the application head (300) by way of jaws (601, 602) which constitute grippers moved by a pneumatic or electric actuator, (604)

wherein the feeder assembly of each reel (401) of the plurality of reels (401) is disposed on a magazine (700) comprising a footing (701) having movable sliders (702*a*, 702*b*) on which the feeder assembly is couplable and uncouplable and guidable to the application head (300), and wherein the application head (300) is engageable with a selected one of the feeder assemblies of the respective reel, and the respective flexible spacer profile (3) is fed to the first glass sheet (2) along a path that winds around the rotational axis (φ) of the application head (300).

* * * * *